US007628707B2

(12) United States Patent
Beach et al.

(10) Patent No.: US 7,628,707 B2
(45) Date of Patent: Dec. 8, 2009

(54) GOLF CLUB INFORMATION SYSTEM AND METHODS

(75) Inventors: Todd P. Beach, San Diego, CA (US); Benoit Vincent, Encinitas, CA (US); Ian Wright, Calgary, Alberta (CA); Thomas Olsavsky, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 11/025,469

(22) Filed: Dec. 28, 2004

(65) Prior Publication Data

US 2005/0181884 A1 Aug. 18, 2005

Related U.S. Application Data

(63) Continuation-in-part of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.

| | |
|---|---|
| ***A63B 57/00*** | (2006.01) |
| ***A63B 69/36*** | (2006.01) |
| ***G06C 3/00*** | (2006.01) |
| ***G06C 27/00*** | (2006.01) |
| ***B25B 25/00*** | (2006.01) |
| ***B63B 59/00*** | (2006.01) |

(52) U.S. Cl. ..... 473/131; 473/219; 473/407; 235/78 G; 235/88 G; 434/252; 116/222; 116/223

(58) Field of Classification Search ..... 473/219–256, 473/407, 324–350, 131; 235/1 B, 78 R, 78 G, 235/88 R, 88 G; 116/222–223, 309, 316, 116/318; 33/1 SB, 1 SD; 434/198, 404, 434/172, 174, 252; 40/495

See application file for complete search history.

(56) References Cited

U.S. PATENT DOCUMENTS

| | | | | |
|---|---|---|---|---|
| 1,133,129 | A | 3/1915 | Govan | |
| 1,518,316 | A | 12/1924 | Ellingham | |
| 1,538,312 | A | 5/1925 | Beat | |
| 1,970,409 | A | 8/1934 | Wiedemann | |
| D107,007 | S | 11/1937 | Cashmore | |
| 2,225,930 | A | 12/1940 | Sexton | |
| 2,360,364 | A | 10/1944 | Reach | |
| 2,681,523 | A * | 6/1954 | Sellers | 40/495 |
| 3,064,980 | A | 11/1962 | Steiner | |

(Continued)

FOREIGN PATENT DOCUMENTS

| | | |
|---|---|---|
| JP | 06-126004 | 5/1994 |

(Continued)

OTHER PUBLICATIONS

Jackson, Jeff, The Modern Guide to Golf Clubmaking, Ohio: Dynacraft Golf Products, Inc., copyright 1994, p. 237.

*Primary Examiner*—Sebastiano Passaniti
(74) *Attorney, Agent, or Firm*—Klarquist Sparkman, LLP

(57) ABSTRACT

One embodiment of a golf club information system for representing a plurality of golf club head configurations includes a first member having thereon a graphic depicting a golf club head with openings and a second member movably coupled to the first member having marks thereon corresponding to a golf club head configuration associated with a predicted golf ball flight path. The first and second members are movable relative to each other to display some of the marks on the second member within the openings in the first member. The displayed marks convey golf club head configuration information.

33 Claims, 21 Drawing Sheets
(8 of 21 Drawing Sheet(s) Filed in Color)

U.S. PATENT DOCUMENTS 3,106,030 A * 10/1963 Pelosi ..... 40/495
3,277,591 A * 10/1966 Rutkofsky ..... 434/78
3,309,017 A * 3/1967 Koskela ..... 235/78 R
3,363,836 A * 1/1968 Lee ..... 235/78 R
3,466,047 A 9/1969 Rodia et al.
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,744,714 A * 7/1973 Banner ..... 235/88 G
3,897,066 A 7/1975 Belmont
3,907,288 A * 9/1975 Hudak ..... 473/407
3,976,299 A 8/1976 Lawrence et al.
3,979,122 A 9/1976 Belmont
3,979,123 A 9/1976 Belmont
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,530,505 A 7/1985 Stuff
D284,346 S 6/1986 Masters
4,607,846 A 8/1986 Perkins
4,730,830 A 3/1988 Tilley
4,736,093 A * 4/1988 Braly ..... 235/88 G
4,754,977 A 7/1988 Sahm
4,795,159 A 1/1989 Nagamoto
4,869,507 A 9/1989 Sahm
4,895,371 A 1/1990 Bushner
4,962,932 A 10/1990 Anderson
5,050,879 A 9/1991 Sun et al.
5,058,895 A 10/1991 Igarashi
5,244,210 A 9/1993 Au
5,253,869 A 10/1993 Dingle et al.
D343,558 S 1/1994 Latraverse et al.
5,291,850 A * 3/1994 Gries et al. ..... 116/222
5,316,305 A 5/1994 McCabe
5,320,005 A 6/1994 Hsiao
5,385,348 A 1/1995 Wargo
5,421,577 A 6/1995 Kobayashi
5,439,222 A 8/1995 Kranenberg
5,441,274 A 8/1995 Clay
5,481,093 A * 1/1996 Rogerson ..... 235/78 R
5,518,243 A 5/1996 Redman
5,533,730 A 7/1996 Ruvang
5,571,053 A 11/1996 Lane
5,603,499 A * 2/1997 Jagosz ..... 273/148 R
5,629,475 A 5/1997 Chastonay
5,683,309 A 11/1997 Reimers
5,709,613 A 1/1998 Sheraw
D392,526 S 3/1998 Nicely
5,746,664 A 5/1998 Reynolds, Jr.
5,769,737 A 6/1998 Holladay et al.
5,776,011 A 7/1998 Su et al.
D409,463 S 5/1999 McMullin
5,911,638 A 6/1999 Parente et al.
D412,547 S 8/1999 Fong
5,935,019 A 8/1999 Yamamoto
5,947,840 A 9/1999 Ryan
5,967,905 A 10/1999 Nakahara et al.
6,015,354 A 1/2000 Ahn et al.
6,019,686 A 2/2000 Gray
6,056,649 A 5/2000 Imai
6,089,994 A 7/2000 Sun
6,149,533 A 11/2000 Finn
6,162,132 A 12/2000 Yoneyama
6,238,303 B1 5/2001 Fite
6,270,422 B1 8/2001 Fisher
6,277,032 B1 8/2001 Smith
6,296,579 B1 10/2001 Robinson
6,348,014 B1 2/2002 Chiu
6,379,265 B1 4/2002 Hirakawa et al.
6,409,612 B1 6/2002 Evans et al.
6,440,009 B1 8/2002 Guibaud et al.
6,514,154 B1 2/2003 Finn
6,527,649 B1 3/2003 Neher et al.
6,530,848 B2 3/2003 Gillig
6,565,448 B2 5/2003 Cameron et al.
6,569,040 B2 * 5/2003 Bradstock ..... 473/407
6,641,487 B1 11/2003 Hamburger
6,669,571 B1 12/2003 Cameron et al.
6,739,983 B2 5/2004 Helmstetter et al.
6,757,572 B1 6/2004 Forest
6,773,360 B2 8/2004 Willett et al.
6,988,960 B2 1/2006 Mahaffey et al.
2002/0137576 A1 9/2002 Dammen
2002/0160854 A1 10/2002 Beach et al.
2003/0130059 A1 7/2003 Billings
2004/0242343 A1 12/2004 Chao

FOREIGN PATENT DOCUMENTS

JP 09-028844 2/1997
JP 10-234902 8/1998
JP 10277187 A 10/1998
JP 2004 222911 A 8/2004
WO WO 01/66199 9/2001
WO WO 03/061773 7/2003

* cited by examiner

GOLF CLUB INFORMATION SYSTEM AND METHODS

CROSS REFERENCE TO RELATED APPLICATION

The present application is a continuation-in-part of U.S. patent application Ser. No. 10/785,692, filed Feb. 23, 2004, now U.S. Pat. No. 7,166,040 which is a continuation-in-part of U.S. patent application Ser. No. 10/290,817, Filed Nov. 8, 2002 now U.S. Pat. No. 6,773,360. These applications are incorporated herein by this reference.

FIELD

The present application is directed to golf club information systems and methods, particularly for use in configuring golf clubs to achieve desired results.

BACKGROUND

The center of gravity of a golf club head is one critical parameter of the club's performance. Upon impact, it greatly affects launch angle and flight trajectory of a struck golf ball. Thus, much effort has been made over positioning the center of gravity of golf club heads. To that end, current driver and fairway wood golf club heads are typically formed of lightweight, yet durable materials, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be later added to the interior of the club head through the club head's hosel opening to obtain a final desired weight of the club head. To achieve significant localized mass, weights formed of high-density materials have been attached to the sole. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity is too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

It should, therefore, be appreciated that there is a need for a system for adjustably weighting a golf club head that allows a golfer to fine-tune the club head to accommodate his or her swing. The present application fulfills this need and others.

SUMMARY

Disclosed below are representative embodiments that are not intended to be limiting in any way. Instead, the present disclosure is directed toward novel and nonobvious features, aspects, and equivalents of the embodiments of the golf club information system described below. The disclosed features and aspects of the embodiments can be used alone or in various novel and nonobvious combinations and sub-combinations with one another.

Briefly, and in general terms, the present application describes a golf club information system and associative methods of using the same that allows a golfer to fine-tune a golf club for his or her swing. According to some embodiments, the golf club includes a removable weight, which may be at various predetermined locations about the golf club head. The golf club may include a plurality of weights, including weights of different mass. Varying placement of the weights enables a golfer to vary impact conditions in the club head, for producing desired golf ball motion paths for a golf ball struck by the golf club.

According to one aspect, an information system for determining golf club head configurations includes a first member with a graphic depicting a golf club head having at least one opening positioned at predetermined locations on the graphic. The information system further includes a second member with marks corresponding to at least one golf club head configuration. The first member and second member are rotatable relative to each other to display at least some of the marks on the second member within the openings in the first member to convey golf club head configuration information.

According to another aspect, a system for achieving a desired golf ball motion path is described. The system includes a golf club with removable weights capable of arrangement in a plurality of weight configurations and a device with a visual representation of multiple predicted golf ball motion paths correlated to some of the plurality of configurations for the golf club. The device also includes instructions for reconfiguring the golf club according to a selected predicted golf ball motion path that best approximates the desired golf ball motion path.

In another embodiment, an information system for providing information for selecting a golf club configuration to achieve a desired golf ball motion path for a golf ball struck by the golf club is described. This embodiment includes a member with a first set of indicia that represent multiple predicted golf ball motion paths and a second set of indicia that represent instructions to reconfigure the golf club according to a selected predicted golf ball motion path. The first set of indicia may represent predicted golf ball motion paths in a graphical format illustrating the flight characteristics of the predicted golf ball motion paths relative to each other. Predicted golf ball motion paths and desired golf ball motion paths may include a trajectory component, a shot shape component and a swingweight component. The second set of indicia includes instructions on how to redistribute or increase/decrease the mass of the golf club. In one embodiment, the first member may be rotatably coupled to the second member. The first member may include a graphic of a golf club head with openings located at various positions on the golf club head. The second set of indicia may specifically include groupings of marks that correspond to instructions on how to reconfigure the golf club and are viewable through the openings on the first member. According to yet another embodiment as herein described, the information system can include a third member positioned between and rotatably coupled to the first and second members. The third member may include several groupings of openings that correspond to respective predicted golf ball motion paths having respective swingweights. The groupings of marks on the second member are viewable through the openings on the first and third members, respectively. In another embodiment, the information system includes an electronic device with a display, such as a personal digital assistant (PDA) or a wireless telephone, where the first set of indicia and the second set of indicia are viewable on the display.

According to another embodiment, a golf accessory for determining proper golf club head configurations for a given golf club for achieving desired golf ball motion paths is described. The embodiment includes a visual representation of multiple predicted golf ball motion paths correlated to golf club head configurations for a single golf club and a device with instructions for reconfiguring the golf club according to a selected one of the predicted golf ball motion paths that best approximates one of the desired golf ball motion paths. The device may include an instruction wheel or an electronic device capable of displaying at least the instructions, such as a PDA or a cellular telephone.

The present disclosure also describes a method for adapting a golf club to achieve a desired motion path for a golf ball struck by the golf club. One embodiment of the method includes providing a database comprising a plurality of predicted golf ball motion paths, with each of the predicted golf ball motion paths having a corresponding golf club head configuration. A desired golf ball motion path is determined and a golf club head configuration corresponding to a predicted golf ball motion path that approximates the desired golf ball motion path is selected from the database. The golf club head is then checked, and if necessary, reconfigured to achieve the selected golf club head configuration by changing a total mass or redistributing a portion of the total mass of the golf club. According to one embodiment, a golf ball is struck with the reconfigured golf club and the motion path the golf ball follows is observed. The observed golf ball motion path is compared with the desired golf ball motion path for discrepancies. Following substantially the process above, the golf club is reconfigured to compensate for differences between the observed golf ball motion path and the desired golf ball motion path.

An embodiment of a method for calculating a predetermined golf ball motion path for a reconfigurable golf club head with removable weights is also described. According to the method, a reconfigurable golf club having a golf club configuration is provided. The predicted golf ball motion path that corresponds with the golf club configuration is then determined by using a golf information system.

A method for configuring a golf club head with removable weights is described herein. One embodiment of the method includes providing a device that has information relating to a plurality of golf club head mass configurations that correspond with desired golf ball flight paths. The method further includes selecting a golf club head mass configuration and altering the mass distribution of the golf club head to achieve the selected golf club head mass configuration. The golf club head mass configuration is altered by removing a first removable weight with a first mass and replacing it with a second removable weight having a second mass.

An information system for determining proper golf club head configurations for achieving desired golf ball motion paths is described. The information system includes storage means for storing a plurality of predicted golf ball motion paths and a plurality of golf club head configurations. The system also includes selecting means for selecting a golf club head configuration that corresponds to a selected predicted golf ball motion path. Additionally, the system includes display means for displaying golf club head configurations.

An information device for determining a golf club head configuration to achieve a desired golf ball motion path for a golf ball struck by the golf club is also described. The device includes a memory, a processor, a display and an input device. The memory stores a plurality of predicted golf ball motions paths and golf club head configurations. The processor is coupled to the memory and calculates a predicted golf ball motion path that approximates the desired golf ball motion path. The display is coupled to the processor and displays a golf club head configuration that is correlated to the predicted golf ball motion paths. The input device is coupled to the processor and receives user inputs.

Another embodiment of an information device for calculating proper golf club head configurations having inputting means for inputting golf ball motion paths, comparing means for comparing entered golf ball motion paths to predicted golf ball motion paths and displaying means for displaying golf club head configurations that best approximates the entered golf ball motion paths.

The present application also discloses an instruction wheel for calculating proper golf club head configurations. The instruction wheel includes a first member that has a graphic of a golf club head with first openings and a second member that has groupings of marks that correspond to a golf club head configuration. The first member and the second member are rotatably coupled such that each grouping is viewable through the first openings upon a proper rotational alignment of the first and second members. According to another embodiment, the instruction wheel includes a third member that has multiple sets of second openings. Each set corresponds to a predicted golf ball flight path and the groupings of marks are viewable through one of the multiple sets of second openings and the first openings upon a proper rotational alignment of the first, second and third members.

The foregoing and additional features and advantages of the disclosed embodiments will become more apparent from the following detailed description, which proceeds with reference to the following drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
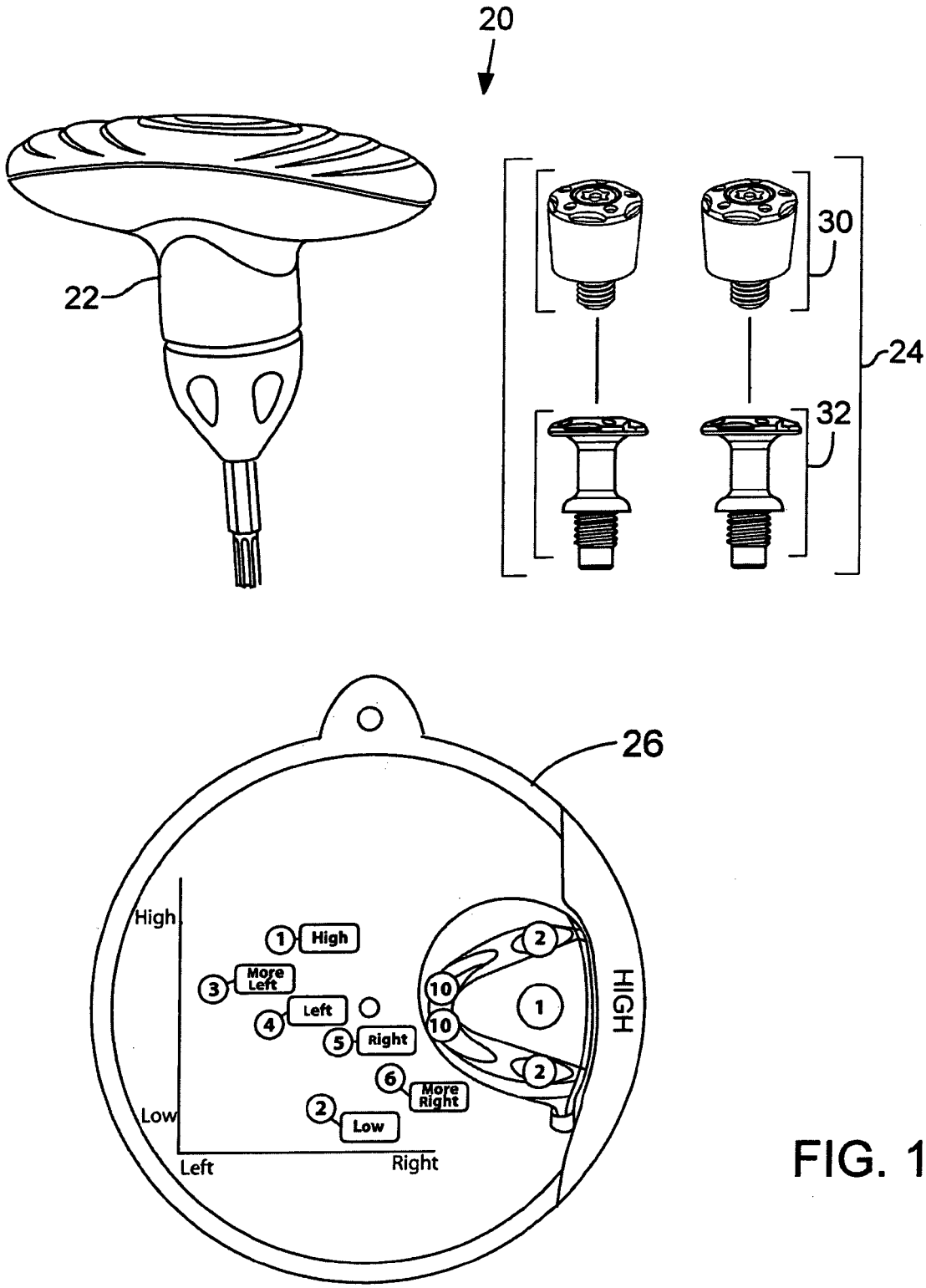
FIG. 1 is a perspective view of an embodiment of a kit for adjustably weighting a golf club head in accordance with the invention.

Now with reference to the illustrative drawing, and particularly FIG. 1, there is shown a kit 20 having a driving tool, i.e., torque wrench 22, and a set of weights 24 usable with a golf club head having conforming recesses, including, for example, weight assemblies 30 and weight screws 23, and an instruction wheel 26. The instruction wheel 26, which is one embodiment of the information system is described below in greater detail.

An exemplary club head 28 includes four recesses 96, 98, 102, 104 disposed about the periphery of the club head 28 (FIGS. 2-5). In the exemplary embodiment, four weights 24 are provided; two weight assemblies 30 of about ten grams and two weight screws 32 of about two grams. Varying placement of the weights within recesses 96, 98, 102 and 104 enables the golfer to vary launch conditions of a golf ball struck by the club head 28, for optimum distance and accuracy. More specifically, the golfer can adjust the position of the club head's center of gravity, for greater control over the characteristics of launch conditions and, therefore, the trajectory and shot shape of a struck golf ball.

With reference to FIGS. 1-5, the weights 24 are sized to be securely received in any of the four recesses 96, 98, 102, 104 of the club head 28, and are secured in place using the torque wrench 22. The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning the center of gravity (CG) of the club head. In the exemplary embodiment, the CG of the club head 28 can be adjustably located in an area adjacent to the sole having a length of about five millimeters measured from front-to-rear and width of about five millimeters measured from toe-to-heel. Each configuration delivers different launch conditions, including launch angle, spin-rate and the club head's alignment at impact, as discussed in detail below.

Figure 9:
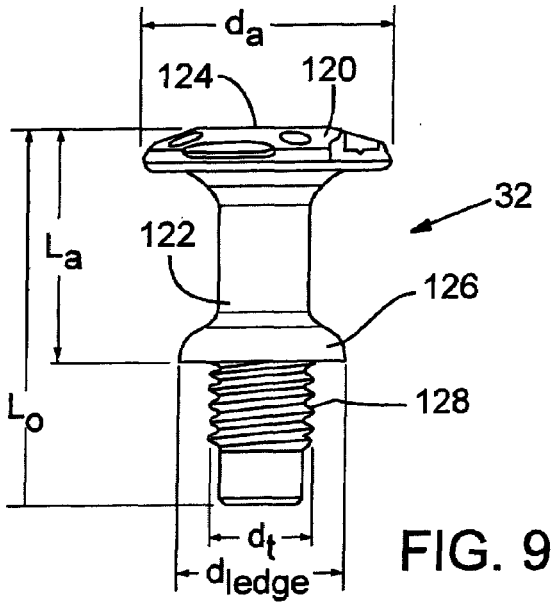
FIG. 9 is a side elevational view of a weight screw of the kit of FIG. 1.

Each of the weight assemblies 30 (FIGS. 10-12) includes a mass element 34, a fastener, e.g., screw 36, and a retaining element 38. In the exemplary embodiment, the weight assemblies 30 are preassembled; however, component parts can be provided for assembly by the user. For weights having a total mass between about one gram and about two grams, weights screws 32 without a mass element preferably are used (FIG. 9). Such weight screws 32 can be formed of stainless steel, and the head 120 of the weight screw preferably has a diameter sized to conform to any of the four recesses 96, 98, 102, 104 of the club head 28.

The kit 20 can be provided with a golf club at purchase, or sold separately. For example, a golf club can be sold with the torque wrench 22, the instruction wheel 26, and the weights 24 (e.g., two 10-gram weights 30 and two 2-gram weights 32) preinstalled. Kits 20 having an even greater variety of weights can also be provided with the club, or sold separately. In another embodiment, a kit 20 having eight weight assemblies is contemplated, e.g., a 2-gram weight, four 6-gram weights, two 14-gram weights, and an 18-gram weight. Such a kit 20 may be particularly effective for golfers with a fairly consistent swing, by providing additional precision in weighting the club head. Also, weights in prescribed increments across a broad range can be available. For example, weights 24 in one gram increments ranging from one gram to twenty-five grams can provide very precise weighting, which would be particularly advantageous for advanced and professional golfers. In such embodiments, weight assemblies 30 ranging between five grams and ten grams preferably use a mass element 34 comprising primarily a titanium alloy. Weight assemblies 30 ranging between ten grams to over twenty-five grams, preferably use a mass element 34 comprising a tungsten-based alloy, or blended tungsten alloys. Other materials, or combinations thereof, can be used to achieve a desired weight mass. However, material selection should consider other requirements such as durability, size restraints, and removability.

Torque Wrench

Figure 7:
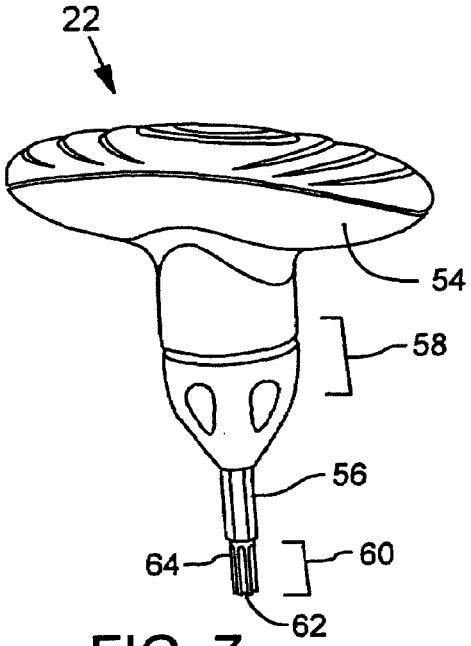
FIG. 7 is a perspective view of the tool of the kit of FIG. 1, depicting a grip and a tip.
Figure 8:
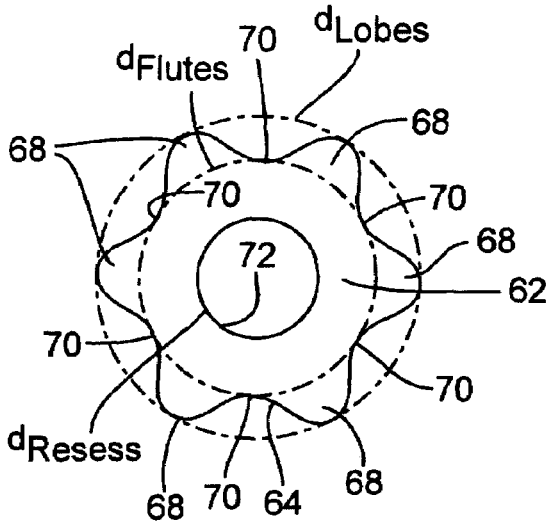
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into the recesses 96, 98, 102, and 104. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs. and forty inch-lbs. of torque. More preferably, the limit is between twenty-seven inch-lbs and thirty-three inch-lbs of torque. In the exemplary embodiment, the wrench 22 is limited to about thirty inch-lbs. of torque. Of course, wrenches having various other types of torque-limiting mechanisms, or even without such mechanisms, can be used. However, if a torque-limiting mechanism is not used, care should be taken not to over-tighten the weights 24.

Figure 10:
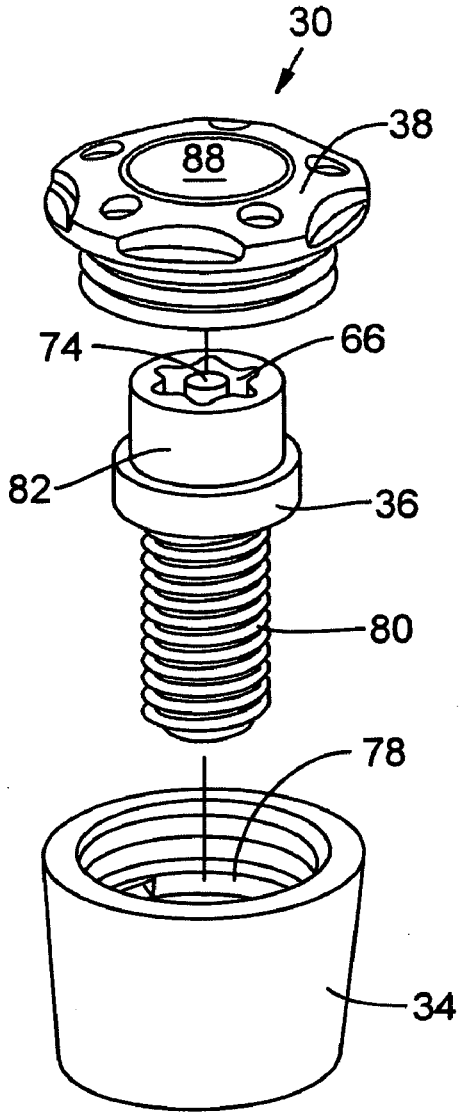
FIG. 10 is an exploded perspective view of a weight assembly of the kit of FIG. 1.
Figure 11:
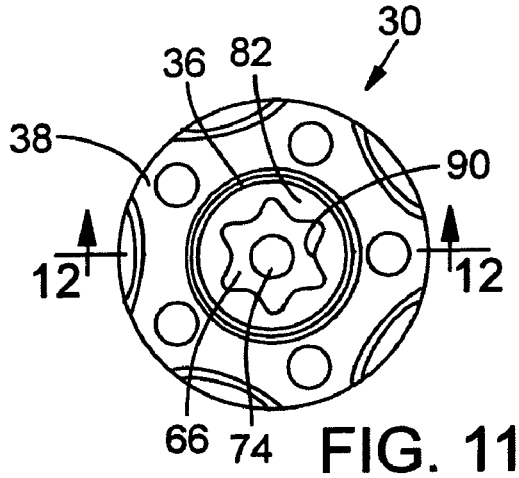
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 10 and 11, the head of each of the weight screws 32 and weight assembly screws 36 define a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{Lobes}$), defined by the crests of the lobes 68, of about 4.50 mm, and trough diameter ($d_{Flutes}$)defined by the troughs of the flutes 70, of about 3.30 mm. The axial recess has a diameter ($d_{Recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, including weight assemblies 30 and weight screws 32, are non-destructively movable about or within golf club head 28. In specific embodiments, the weights 24 can be attached to the club head 28, removed, and reattached to the club head without degrading or destroying the weights or the golf club head. In other embodiments, the weights are accessible from an exterior of the golf club head.

With reference now to FIG. 9, each weight screw 32 has a head 120 and a body 122 with a threaded portion 128. The weight screws 32 are preferably formed of titanium or stainless steel, providing a weight with a low mass that can withstand forces endured upon impacting a golf ball with the club head 28. In the exemplary embodiment, the weight screw 32 has an overall length ($L_o$) of about 18.3 mm and a mass of about two grams. In other embodiments, the length and composition of the weight screw 32 can be varied to satisfy particular durability and mass requirements. The weight screw head 120 is sized to enclose the corresponding weight recess, i.e., 96, 98, 102, 104 (FIG. 2) of the club head 28, such that the periphery of the weight screw head 120 generally abuts the side wall of the recess. This helps prevent debris from entering the corresponding recess. Preferably, the weight screw head 120 has a diameter ranging between about 11 mm and about 13 mm, corresponding to weight recess diameters of various exemplary embodiments. In this embodiment, the weight screw head has a diameter of about 12.3 mm. The weight screw head defines a socket 124 having a multi-lobular configuration sized to operatively mate with the wrench tip 60.

The body 122 of the weight screw 32 includes an annular ledge 126 located in an intermediate region thereof. The ledge 126 has a diameter ($d_{ledge}$) greater than that of the threaded openings 110 defined in the recesses 96, 98, 102, 104 of the club head 28 (FIG. 2), thereby serving as a stop when the weight screw 32 is tightened. In the embodiment, the annular ledge 126 is a distance ($L_a$) of about 11.5 mm from the weight screw head 120 and has a diameter ($d_a$) of about 6 mm. The weight screw body 122 further includes a threaded portion 128 located below the annular ledge 126. In this embodiment, M5×0.6 threads are used. The threaded portion 128 of the weight screw body 122 has a diameter ($d_t$) of about 5 mm and is configured to mate with the threaded openings 110 defined in the recesses 96, 98, 102, 104 of the club head 28.

Figure 12:
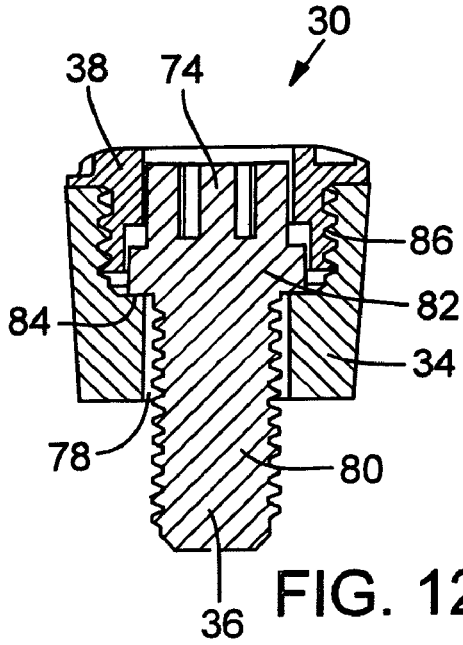
FIG. 12 is a cross-sectional view of the weight assembly of FIG. 10, taken along line 12-12 of FIG. 11.

With reference now to FIGS. 10-12, each mass element 34 of the weight assemblies 30 defines a bore 78 sized to freely receive the weight assembly screw 36. As shown in FIG. 12, the bore 78 includes a lower non-threaded portion and an upper threaded portion. The lower portion is sufficiently sized to freely receive a weight assembly screw body 80, while not allowing the weight assembly screw head 82 to pass. The upper portion of the bore 78 is sufficiently sized to allow the weight assembly screw head 82 to rest therein. More particularly, the weight assembly screw head 82 rests upon a shoulder 84 formed in the bore 78 of the mass element 34. Also, the upper portion of the bore 78 has internal threads 86 for securing the retaining element 38. In constructing the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then threaded into the upper portion of the bore 78, thereby capturing the weight assembly screw 36 in place. A thread locking compound can be used to secure the retaining element 38 to the mass element 34.

The retaining element 38 defines an axial opening 88, exposing the socket 66 of the weight assembly screw head 82 and facilitating engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about a longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

Club Head

As illustrated in FIGS. 2-5, a golf club head 28 of the present application includes a body 92. The body 92 can include a crown 141, sole 143, skirt 145 and face plate 148 defining an interior cavity 150. The body further includes a heel portion 151, toe portion 153 and rear portion 155.

The crown 141 includes an upper portion of the golf club head 28 above a peripheral outline of the head and top of the face plate 148.

The sole 143 includes a lower portion of the golf club head 28 extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10 mm to about 12 mm above the lowest point when the club head is ideally positioned. A golf club head, such as the club head 28, can be ideally positioned when angle 163 measured between a plane tangent to an ideal impact location on the face plate 148 and a perfectly vertical plane relative to the ground is approximately equal to an angle between a longitudinal axis of the hosel or shaft and the ground 161. The ideal impact location is disposed at the geometric center of the face plate 148. The sole 143 can also include a localized zone 189 proximate the face plate 148 having a thickness between about 1 mm and 3 mm, and extending rearwardly away from the face plate a distance greater than about 5 mm.

The skirt 145 includes a side portion of the golf club between the crown and the sole that extends across a periphery of the golf club head, excluding the face plate, from the toe portion 153, around the rear portion 155, to the heel portion 151.

With reference again to FIGS. 2-5, the club head 28 includes a thin-walled body 92 and a face plate 148.

The weights 24 are accessible from the exterior of the club head 28 and securely received into the recesses 96, 98, 102, and 104. The weight assemblies 30 preferably stay in place via a press fit. Weights 24 are configured to withstand forces at impact, while also being easy to remove. The four recesses 96, 98, 102, and 104 of the club head 28 are positioned low about periphery of the body 92, providing a low center of gravity and a high moment of inertia. More particularly, first and second recesses 96, 98 are located in a rear portion 155 of the club head 28, and the third and fourth recesses 102 and 104 are located in a toe portion 153 and a heel portion 151 of the club head 28, respectively. Fewer, such as two or three weights, or more than four weights may be provided as desired.

Figure 5:
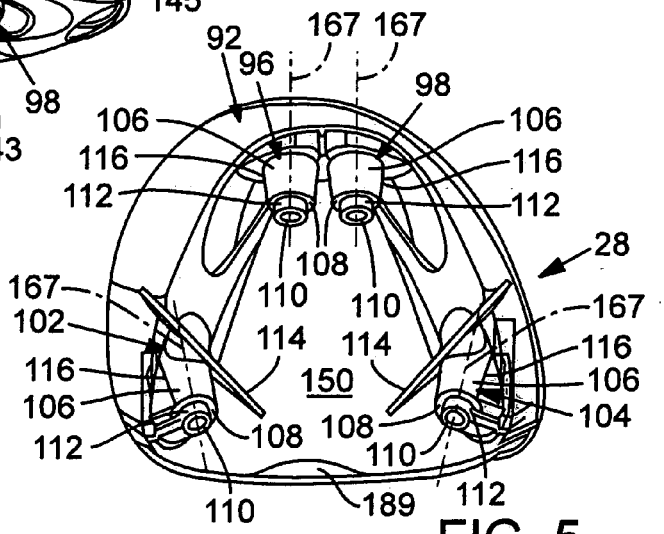
FIG. 5 is a cross sectional view of the club head of FIG. 2, taken along line 5-5 of FIG. 4.

The recesses 96, 98, 102, and 104 are each defined by a recess wall 106 defining a weight cavity 116 and a recess bottom 108. The recesses have a weight recess radial axis 167 defined as a longitudinal axis passing through a volumetric centroid, i.e., the center of mass or center of gravity, of the weight recess. The recess bottom 108 defines a threaded opening 110 for attachment of the weights 24. The threaded opening 110 is configured to receive and secure the threaded portion of the weight assembly screw body 80. In this embodiment, the threaded portions of the weight assembly 30 and weight screw 32, respectively, have M5×0.6 threads. The threaded opening 110 may be further defined by a boss 112 extending either inward or outward relative to the weight cavity 116. Preferably, the boss 112 has a length at least half the length of the body 80 of the weight assembly screw 36 and, more preferably, the boss 112 has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss 112.

Figure 2:
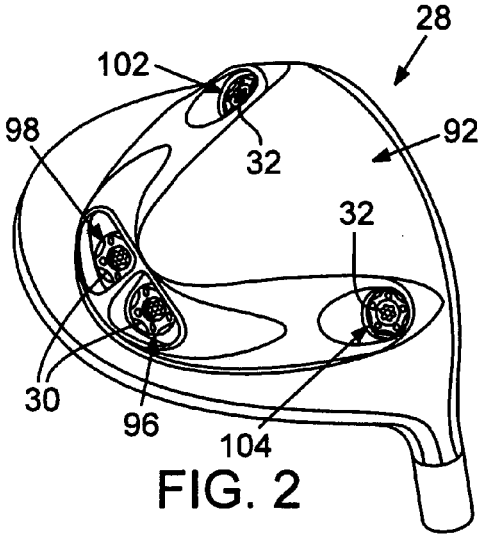
FIG. 2 is a bottom and rear side perspective view of a club head having four weight recesses.
Figure 3:
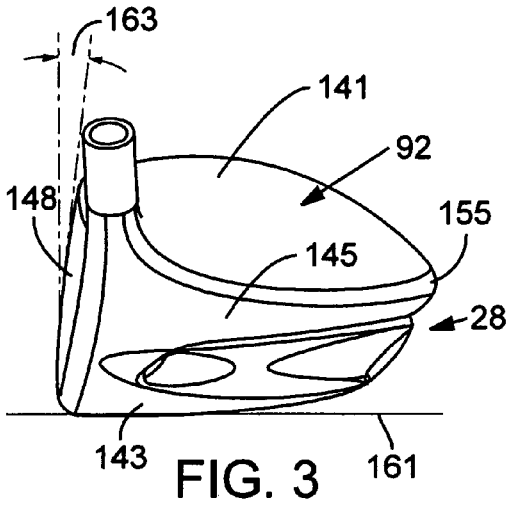
FIG. 3 is a side elevational view of the club head of FIG. 2, depicted from the heel side of the club head.
Figure 4:
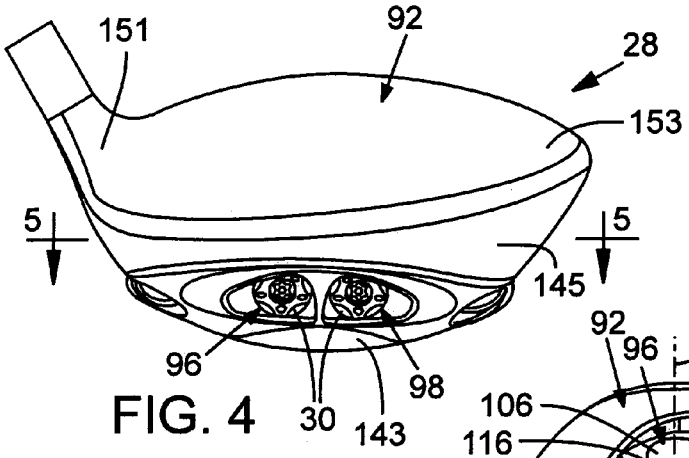
FIG. 4 is a rear elevational view of the club head of FIG. 2.

As depicted in FIG. 5, the club head 28 includes fins 114 disposed about the forward recesses 102 and 104, providing support within the club head and reducing stress on the walls during impact. In this embodiment, the club head 28 has a volume of about 460 cc and a total mass of about 200 grams, of which the face plate 148 accounts for about 24 grams. As depicted in FIG. 2, the club head 28 is weighted in accordance with the first configuration (i.e., "high") of Table 1, above. With this arrangement, a moment of inertia about a vertical axis at a center of gravity of the club head 28, Izz, is about 405 kg-mm$^2$. Various other designs of club heads and weights may be used, such as those disclosed in Applicant's co-pending application Ser. No. 10/290,817 filed Nov. 8, 2002, which is herein incorporated by reference. Furthermore, other club head designs known in the art can be adapted to take advantage of features of the present invention.

To attach a weight assembly 30 in a recess of the club head 28, the threaded portion of the weight assembly screw body 80 is positioned against the threaded opening 110 of the recess. With the tip 60 of the wrench 22 inserted through the aperture 88 of the retaining element 38 and engaged in the socket 66 of the weight assembly screw 36, the user rotates the wrench to screw the weight assembly 30 in place. Pressure from the engagement of the weight assembly screw 36 provides a press fit of the mass element 34 to the recess. As sides of the mass element 34 slide tightly against the recess wall 106, the torque limiting mechanism of the wrench 22 prevents over-tightening of the weight assembly 30.

Weight assemblies 30 are also configured for easy removal, if desired. To remove, the user mates the wrench 22 with the weight assembly 30 and unscrews it from a club head 28. As the user turns the wrench 22, the head 82 of the weight assembly screw 36 applies an outward force on the retaining element 38, thereby extracting the mass element 34 from the weight cavity 116. A low friction material can be provided on surfaces of the retaining element 38 and the mass element 34 to facilitate free rotation of the head 82 of the weight assembly screw 36 with respect to the retaining element 38 and the mass element 34.

Information System

Described below are representative embodiments of approaches to providing a user with information to improve his or her golf game, and in particular, to adapt a golf club to the user's personal characteristics. As described below, the information includes instructions for modifying the golf club, and specifically, for changing its physical configuration, including the weight and/or weight distribution of the golf club head.

According to some embodiments, the information system provides information in an easy-to-use visual format, such as, e.g., in a table, chart, graph, database, matrix or other convenient format. Desirably, the system is organized in a manner allowing the user to select or extract specific information easily. Selection criteria that guide the user to the specific information are readily accessible, either as presented in a static format, or as embodied in a selector that may dynamically assist the user in retrieving the appropriate information.

According to some embodiments, the information system is a portable and easy-to-use graphical device. According to other embodiments, the information system is embodied for use on microprocessor-based devices, such as, but not limited to, computers, wireless telephones, personal digital assistants and other personal electronic devices, and other such devices.

FIG. 6 EXAMPLE

As introduced above, the instruction wheel 26 is one specific implementation of the information system.

Figure 6:
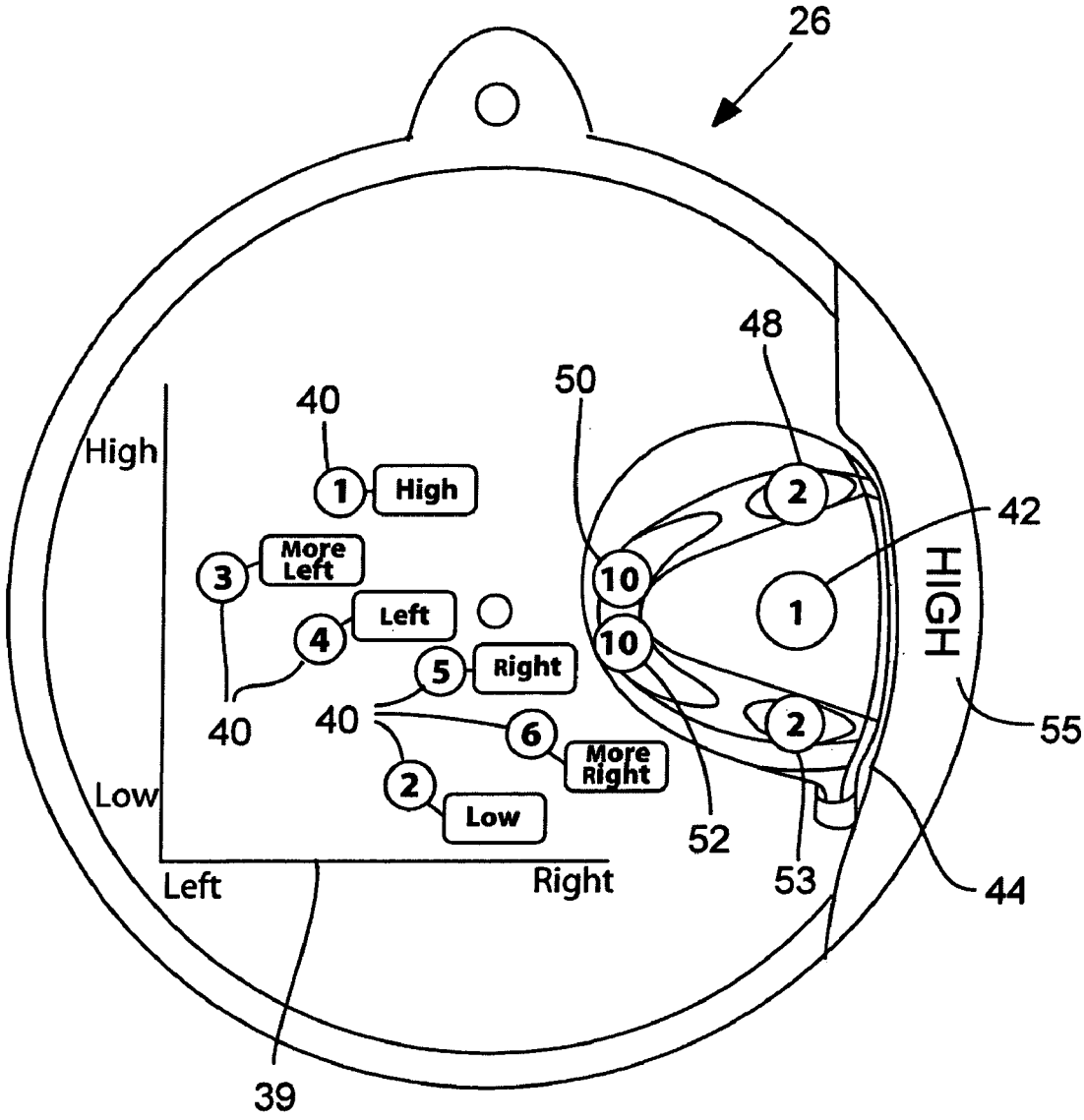
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion chart corresponds to the directional control of the ball's shot shape, ranging from left to right. In the exemplary embodiment, the motion path chart 39 identifies six different weight configurations 40. Each configuration is plotted as a point on the motion path chart 39. Of course, other embodiments can include a different number of configurations, such as, for kits having a different number or variety of weights. Also, other approaches for presenting instructions to the golfer can be used, for example, charts, tables, booklets, and so on. The six weight configurations of the exemplary embodiment are listed below in Table 1.

TABLE 1

Weight Configurations for Instruction Wheel

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

In use according to one method, the golfer selects, from the various motion path chart descriptions, the desired effect on the ball's motion path. For example, if hitting into high wing, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the wheel instruction 26 until the desired configuration number is visible in the center opening 42, i.e., an opening in the instruction wheel 26. The golfer then reads the weight placement for each of the four locations through openings, i.e., openings 48, 50, 52, 53 in the instruction wheel 26 as shown on the graphic 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear recesses 96, 98 and two 2-gram weights are placed in the forward recesses 102, 104 (FIG. 2). If another configuration is selected, the instruction wheel 26 depicts the corresponding weight distribution, as provided in Table 1, above.

FIG. 13 EXAMPLE

Figure 13:
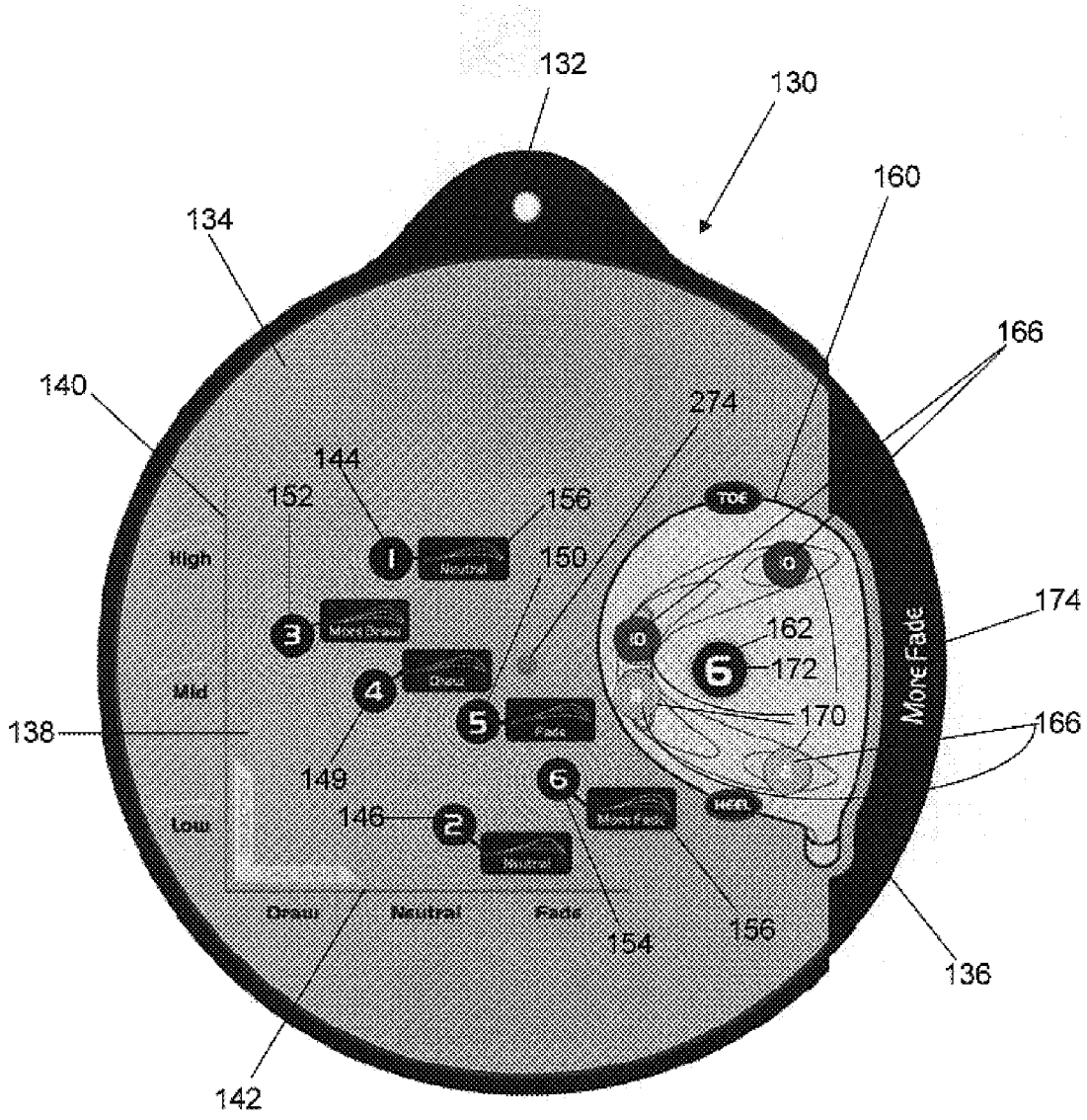
FIG. 13 is a top plan top view of one embodiment of a disclosed golf club information system, showing a first member movably connected to an underlying second member.

With reference to FIG. 13, an information system 130 according to another specific embodiment of the present application is a device with one or more members having indicia used in association with each other. The members may be arranged such that they overlap each other, and they may be connected together but movable relative to each other. For example, one member might be slidable or rotatable relative to the other member.

An information device 132 that instructs the golfer or other user in selecting and configuring a golf club head configuration to achieve a desired golf ball motion path is shown in FIG. 13. The information device 132 may provide instructions on changing the weight or mass of the golf club head 28 to achieve the desired golf ball motion path. A golf ball motion path can be defined as the line a golf ball travels after being struck by a golf club.

Typically, a golf ball motion path can be divided into a trajectory component and a shot shape component, although other components may be devised. The trajectory component is the height and associated angle of the path a golf ball travels after being struck by a golf club. The trajectory component includes varying degrees of high, low and medium trajectory motion paths. The shot shape component includes a draw shot shape, fade shot shape or neutral shot shape motion path. The draw shot shape motion path is a motion path of a struck golf ball in which the ball curves gently right-to-left for a right-handed player, or left-to-right for a left-handed player. A fade shot shape motion path is a motion path of a struck golf ball in which the ball tends to curve gently from left to right, for a right-handed player, or right-to-left for a left-handed player. A neutral shot shape motion path is a motion path of a struck golf ball in which the ball tends to travel in a straight path. A predicted golf ball motion path is the golf ball motion path that a golf ball will consistently follow after being struck by a golf club with a particular golf club configuration and swung in a theoretically ideal manner.

The golf club configuration, including the weight and/or weight distribution of the golf club head, influences the particular golf ball motion path an its components, e.g., trajectory and shot shape, by affecting launch conditions of a golf ball struck by the golf club. Generally, the launch angle, i.e., the angle between the path followed by a golf ball struck by a golf club and the ground, affects the trajectory component. The higher the launch angle, the higher the trajectory; the lower the launch angle, the lower the trajectory. The spin rate, i.e., the rate a golf ball struck by a golf club spins around an axis of the golf ball that is substantially perpendicular to the ground, affects the shot shape component. For the right-handed golfer, the more spin in a counterclockwise direction looking down on the ball, the more draw the shot shape will have, and the more spin in a clockwise direction looking down on the ball, the more fade the shot shape will have.

In the embodiment shown in FIG. 13, device 132 has a first member 134 and a second member 136. The first member 134 overlies and is associated with the second member 136. The first member 134 and the second member 136 are movably connected, and in this specific implementation they are rotatably interconnected.

The first member 134 includes a visual representation illustrating multiple predicted golf ball motion paths corresponding to respective golf club head physical configurations. For example, in the specific implementation of FIG. 13, the first member 134 includes a graph 138 of multiple predicted golf ball motion paths corresponding to respective golf club head mass configurations, which are shown relative to each other. The graph's y-axis 140 corresponds to predicted golf ball motion path trajectory components, generally ranging, in this example, from low to high. The x-axis 142 corresponds to predicted golf ball motion path shot shape components, generally ranging, in this example, from draw to fade.

In an exemplary embodiment shown in FIG. 13, graph 138 identifies six different predicted golf ball motion paths as respective points on the graph. The predicted golf ball motion path points include, but are not limited to, a neutral shot shape with a high trajectory motion path point 144, a neutral shot shape with a low trajectory motion path point 146, a weak draw shot shape with a medium trajectory motion path point 149, a weak fade shot shape with a medium trajectory motion path point 150, a strong draw shot shape with a medium trajectory motion path point 152, and a strong fade shot shape with a low trajectory motion path point 154. In this embodiment, each predicted golf ball motion path point includes a numerical, alphabetical or other graphical identifier.

In some embodiments, a graphic of the trajectory component and/or shot shape component associated with the predicted golf ball motion paths may correspond with the points on the graph. For example, as shown in FIG. 13, graphics or graphical representations 156 are graphically associated with the predicted golf ball motion path points of graph 138. Each of the graphical representations 156 may include a description of the predicted golf ball motion path component and/or graphical illustration of the predicted golf ball motion path trajectory component and/or shot shape component. Graphical representations, including descriptions and illustrations of the predicted golf ball motion paths, assist the user in determining what type of golf ball motion path should result from hitting a golf ball with a specific golf club configuration.

As shown in the specific embodiment of FIG. 13, the graph 138 can include six predicted golf ball motion path points 144, 146, 149, 150, 152 and 154 representing six possible golf club head configurations, each effecting launch conditions that promote a golf ball struck by the golf club to follow the corresponding predicted golf ball motion path. For example, a first configuration "1" corresponding to predicted golf ball motion path point 144 having a neutral shot shape and a high trajectory, has a CG in a center-back location, resulting in a high launch angle and low spin launch condition, which predictably results in a struck golf ball motion path having a neutral shot shape and a high trajectory. As another example, for a second configuration "3" corresponding to predicted golf ball motion path point 152 having a strong draw shot shape and a medium trajectory, the CG is in a middle location close to the heel of the golf club, resulting in an average launch angle and high counterclockwise spin rate, which predictably results in a struck golf ball motion path having a strong draw shot shape and a medium trajectory.

Figure 14:
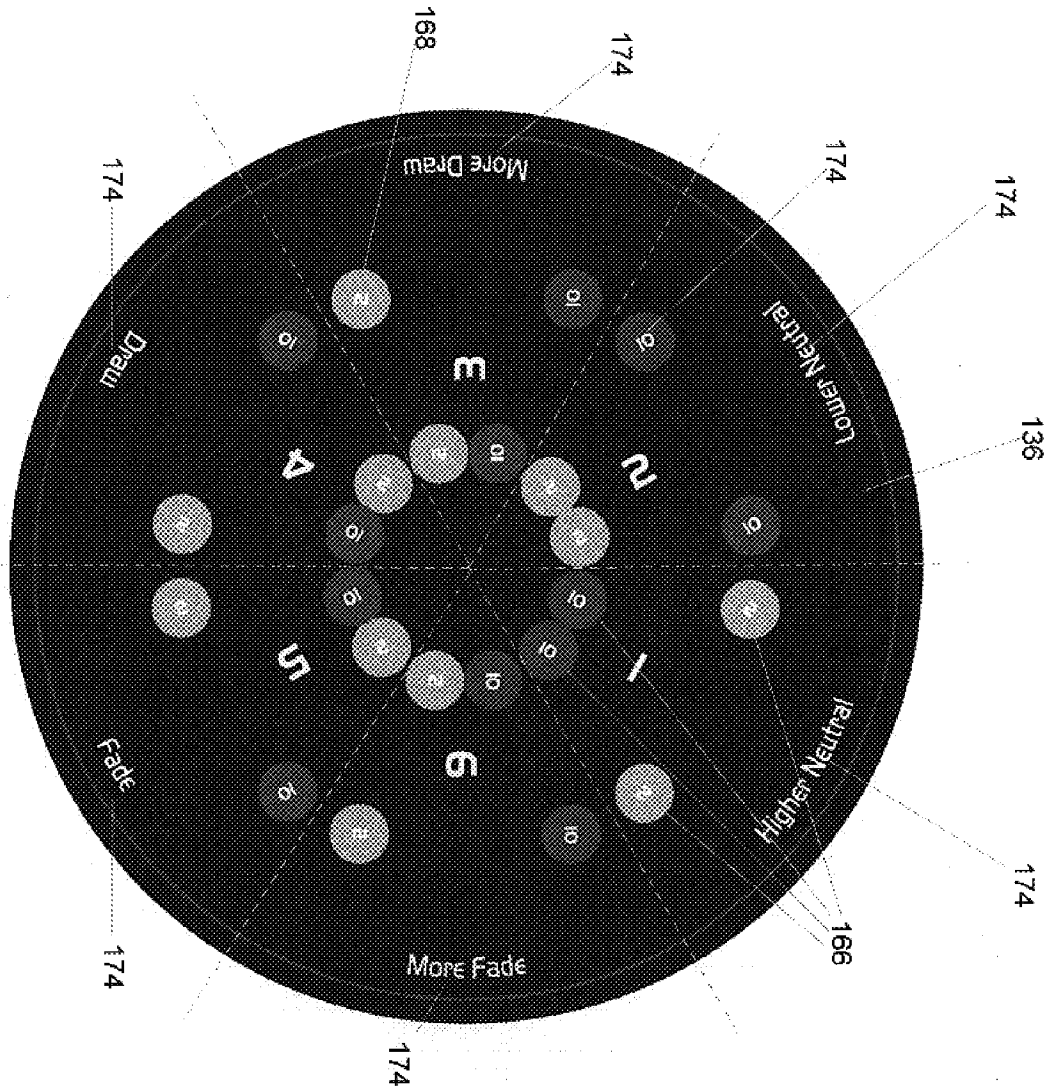
FIG. 14 is a top plan view of the second member of the information system of FIG. 13.

According to one embodiment shown in FIG. 13, multiple golf club head configurations corresponding to predicted golf ball motion paths are graphically represented on device 132. For example, as best shown in FIG. 14, each head mass configuration is represented by correlated multiple marks 166 located on the second member 136. Each mark 168 can represent a weight 24 having a predetermined mass, such as, e.g., a 10-gram mass or a 2-gram mass. The correlated multiple marks 166 can be schematically arranged according to the locations of weights 24 around a golf club head 28. For example, as shown in FIGS. 13 and 14, the correlated multiple marks 166 include four marks 168, where each mark represents a weight having a mass of either 10-grams or a 2-grams. Each mark is positioned on the second member 136 to correspond with the location of the weight 24, where the location can be one of the four recesses 96, 98, 102, and 104, positioned around the periphery of the golf club head 28 (FIGS. 2-5).

Figure 15:
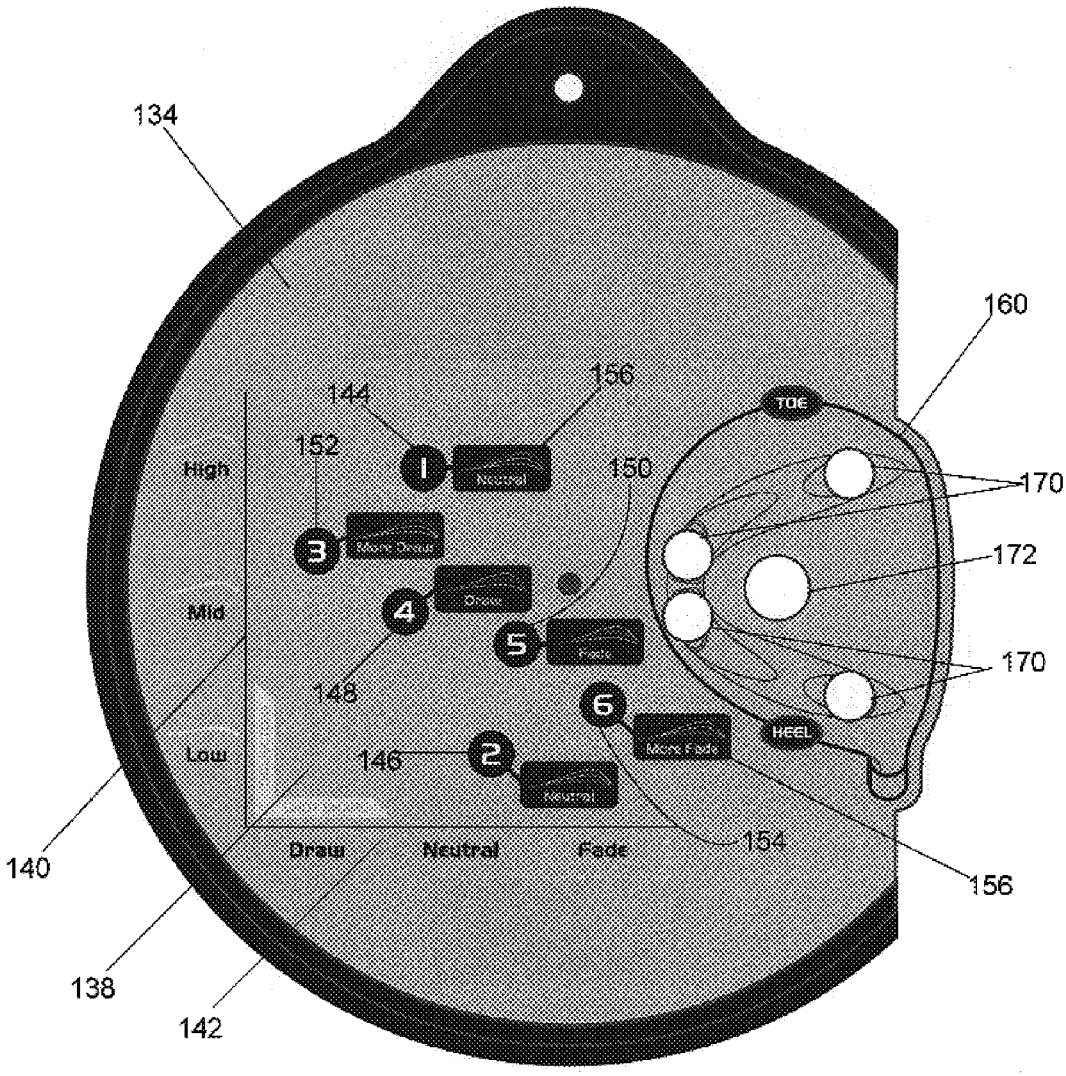
FIG. 15 is a top plan view of the first member of the information system of FIG. 13.

Conveniently, the correlated multiple marks 166 of FIGS. 13 and 14 can be displayed in openings 170 (FIGS. 13 and 15) located on the first member 134 upon proper rotational alignment. Proper rotational alignment generally is achieved when a golf club configuration corresponding with a respective selected predicted golf ball motion path are conveyed via the information system. For the embodiment shown in FIG. 13, proper rotational alignment occurs when a set of correlated multiple marks 166 that corresponds with a selected predicted golf ball motion path are aligned with openings 170 on the first member 134. The openings 170 are positioned at locations on a graphic 160 depicting a golf club head also located on the first member 134. Each opening 170 is positioned at a location on the graphic 160 corresponding to the location of a recess for receiving removable weights on the golf club head. For example, the openings 170 include four openings corresponding to the location of the four recesses 96, 98, 102 and 104 around the periphery of golf club head 28 (FIGS. 2-5). More specifically, as shown in FIG. 13, when the predicted golf ball motion path associated with predicted golf ball motion path point 144, described in this working embodiment as "Higher Neutral," is selected, a golf club head mass configuration having two 2-g weights and two 10-g weights is associatively displayed through openings 170.

Figure 16:
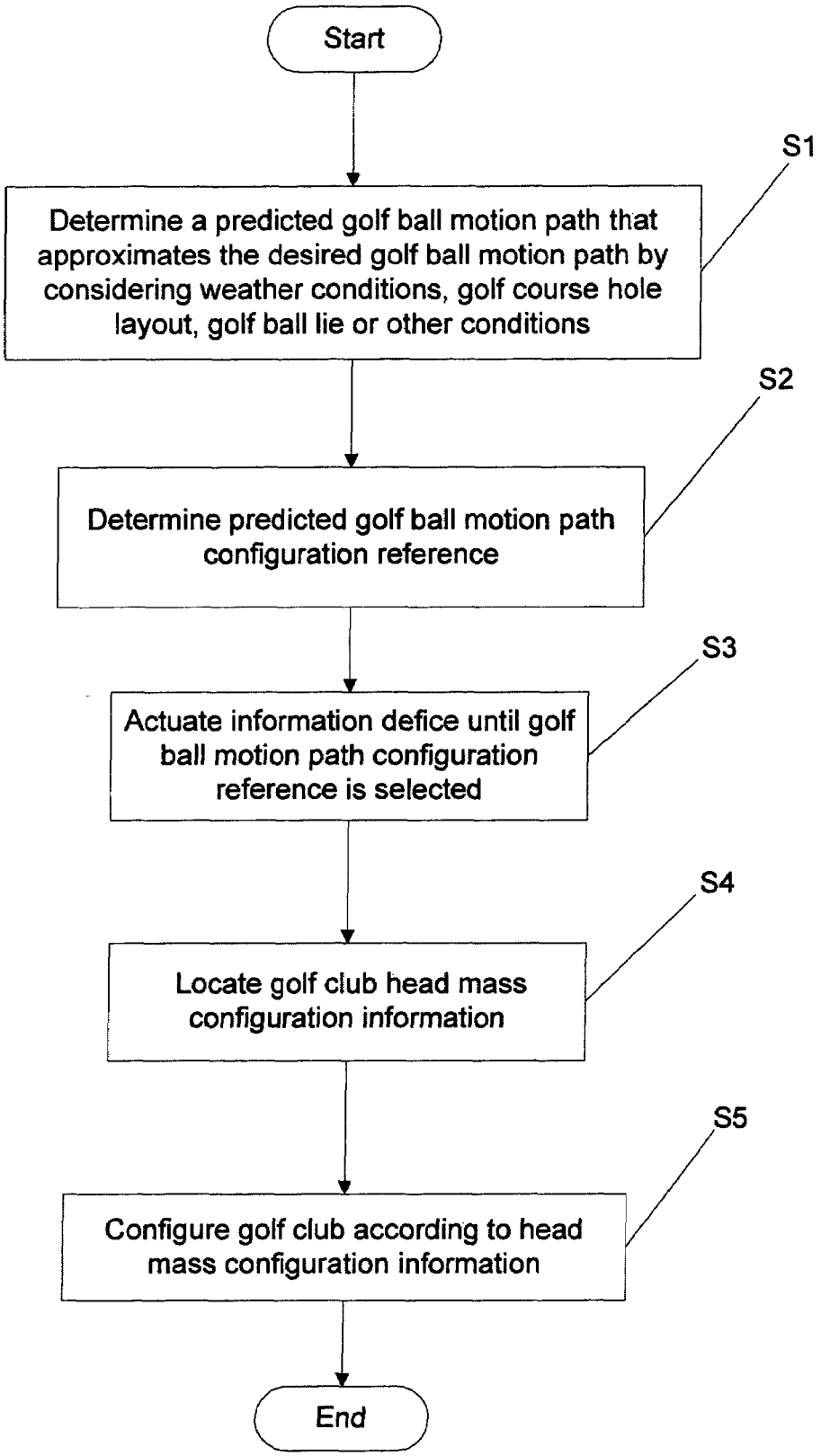
FIG. 16 is a flow chart of a method of using a golf club information system for an advanced or expert golfer.

Another embodiment of a method is suited for an advanced or expert golfer, e.g. a golfer having a golf swing that tends to result in a struck golf ball flight path that insignificantly deviates from or is the same as an intended flight path. As shown in FIG. 16, a user selects a predicted golf ball motion path from one of the multiple predicted golf ball motion paths points 144, 146, 149, 150, 152 or 154 from graph 138 that best approximates a desired golf ball motion path determined by the user.

In Step S1, a user can determine a desired golf ball motion path based on multiple factors. For example, if hitting into a strong wind, the user may desire a low trajectory motion path such as represented by predicted golf ball motion path point 146. As another example, if a golf course hole layout includes a dogleg right, i.e., a fairway of the hole extends in a generally left-to-right direction, a user may desire a fade shot shape motion path such as represented by predicted golf ball motion path 150 or 154. As yet another example, the golf ball lie, i.e., the position of a golf ball on a golf course hole when the ball is at rest, may influence the motion path the golf ball follows after being struck by a golf club. For example, a golf ball may be on an uphill lie, i.e., the ground proximate the ball and the user is generally increasing in elevation in a direction away from the user when the user is facing the golf ball, the golf ball tends to have a golf ball motion path with a draw shot shape. In this situation, a user may desire to offset the effects of the uphill lie by selecting a predicted golf ball motion path with a fade shot shape such as represented by predicted golf ball motion path 150 or 154. In contrast, a golf ball may have a downhill lie, i.e., the ground proximate the ball and the user is generally decreasing in elevation in a direction away from the user when the user is facing the golf ball, the golf ball tends to have a golf ball motion path with a fade shot shape. A user may then desire to offset the effects of the downhill lie by selecting a predicted golf ball motion path with a draw shot shape such as represented by predicted golf ball motion path point 149 or 152.

Once a predicted golf ball motion path is determined that best approximates the desired golf ball motion path, in Step S2, the user selects a predicted golf ball motion path configuration reference associated with the first predicted golf ball motion path, and, in Step S3, actuates, such as by rotating, first member 134 relative to second member 136, or vice versa, until the selected configuration reference is viewed. In one embodiment, the configuration reference is a reference number 162, letter or other identifier that is viewable through center opening 172. In another embodiment, the configuration reference is a predicted golf ball motion path description 174 located on a periphery of second member 136 and viewable upon proper rotational alignment. In yet another embodiment, as shown in FIG. 13, the configuration reference is a combination of a reference number 162 viewable through center member 172 and a description 174 located on the periphery of second member 136. In the specific example of FIG. 13, configuration reference "1" is shown in the center opening 172 and the corresponding description "Higher Neutral" is shown on the periphery of the second member 136.

As shown in FIG. 13, when a predicted golf ball motion path configuration reference is selected, e.g., displayed, such as, e.g., after proper rotational alignment of the members, the head mass information is available. Specifically, with reference to FIGS. 13 and 14, the marks 166 representing the golf club head mass configuration corresponding to the predicted golf ball motion path are viewable through openings 170 located on graphic 160 of golf club head 28. In Step S4, the marks 166 are located and in Step S5, the user is able to utilize the golf club head mass configuration correlated multiple marks 166 as displayed to configure the golf club head mass by arranging the weights 24 according to the marks. For example, for the specific "Higher Neutral" example of FIG. 13, the user would attach two 10-gram weights in the rear recesses 96, 8 and two 2-gram weights in the forward recesses 102, 104 of club head 28 (FIGS. 2-5).

While the above embodiment of a method of using a golf club information system generally involves selecting one of the multiple predicted golf ball motion paths and determining a corresponding golf club configuration, it is recognized that a user could practice the method in a reverse order. A user may forget or want to know the type of golf ball motion path that is likely to result from striking a golf ball with a golf club having a particular golf club configuration.

Figure 17:
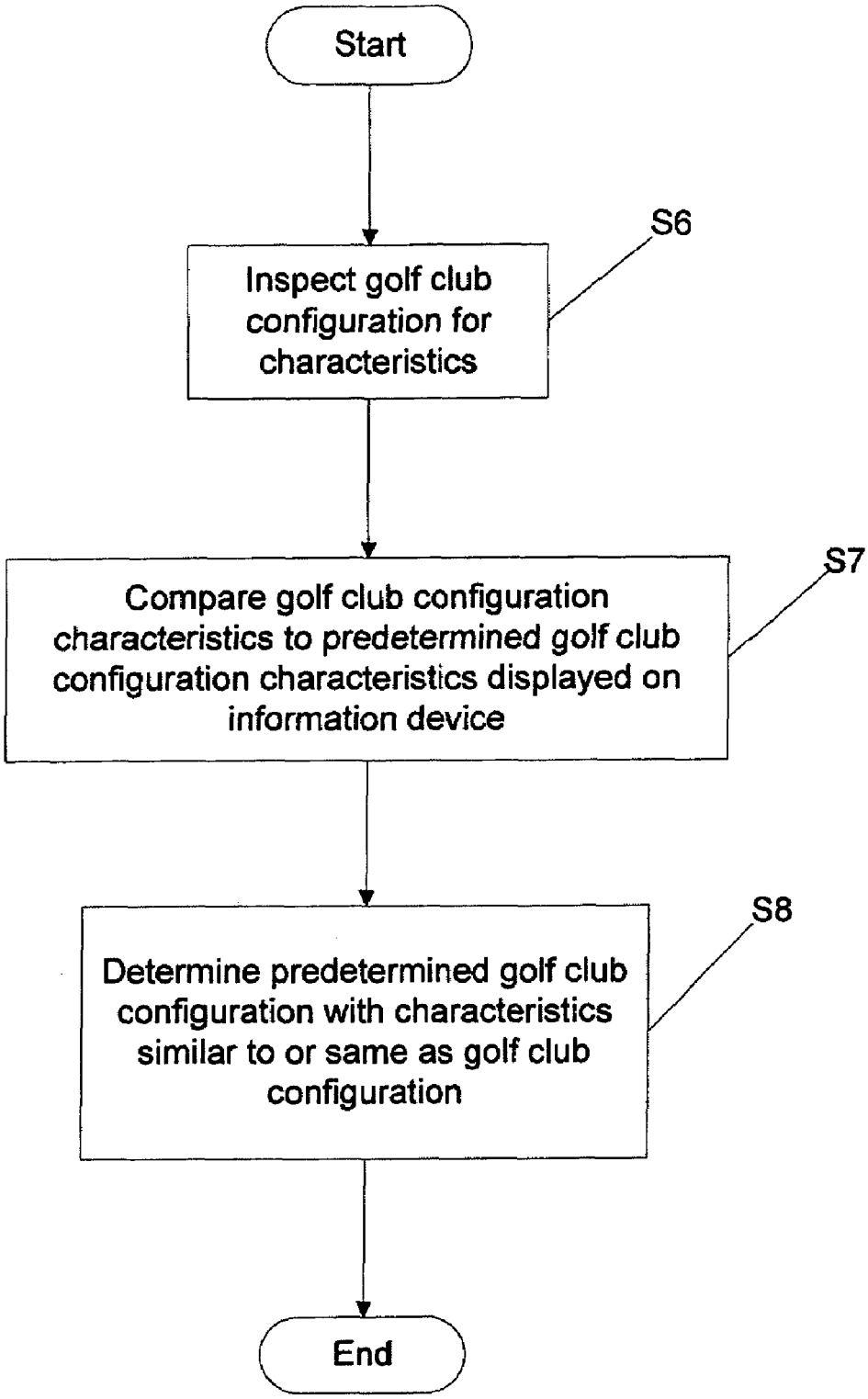
FIG. 17 is a flow chart of a method of using a golf club information system for determining a golf club's predetermined golf club configuration.

Accordingly, another embodiment of a method of using a golf club information system, as shown in FIG. 17, includes providing a golf club having a golf club configuration and determining the predicted golf ball motion path that corresponds with the golf club configuration. In Step S6 of this method, a user inspects a golf club configuration for various characteristics, such as, but not limited to, weight cartridge weights and locations on the golf club. In Step S7, the golf club configuration characteristics are compared with the multiple predetermined golf club configuration characteristics until, in Step S8, a predetermined golf club configuration having characteristics similar or identical to the golf club configuration is found. In some embodiments, the predetermined golf club configurations are graphically illustrated on the information system, such as on a first member of an instruction wheel. Once a similar or identical predetermined golf club configuration is found, its predicted golf ball motion path, i.e., the motion path that is likely to result from striking a golf ball with the golf club having the particular golf club configuration, can be determined.

Figure 18:
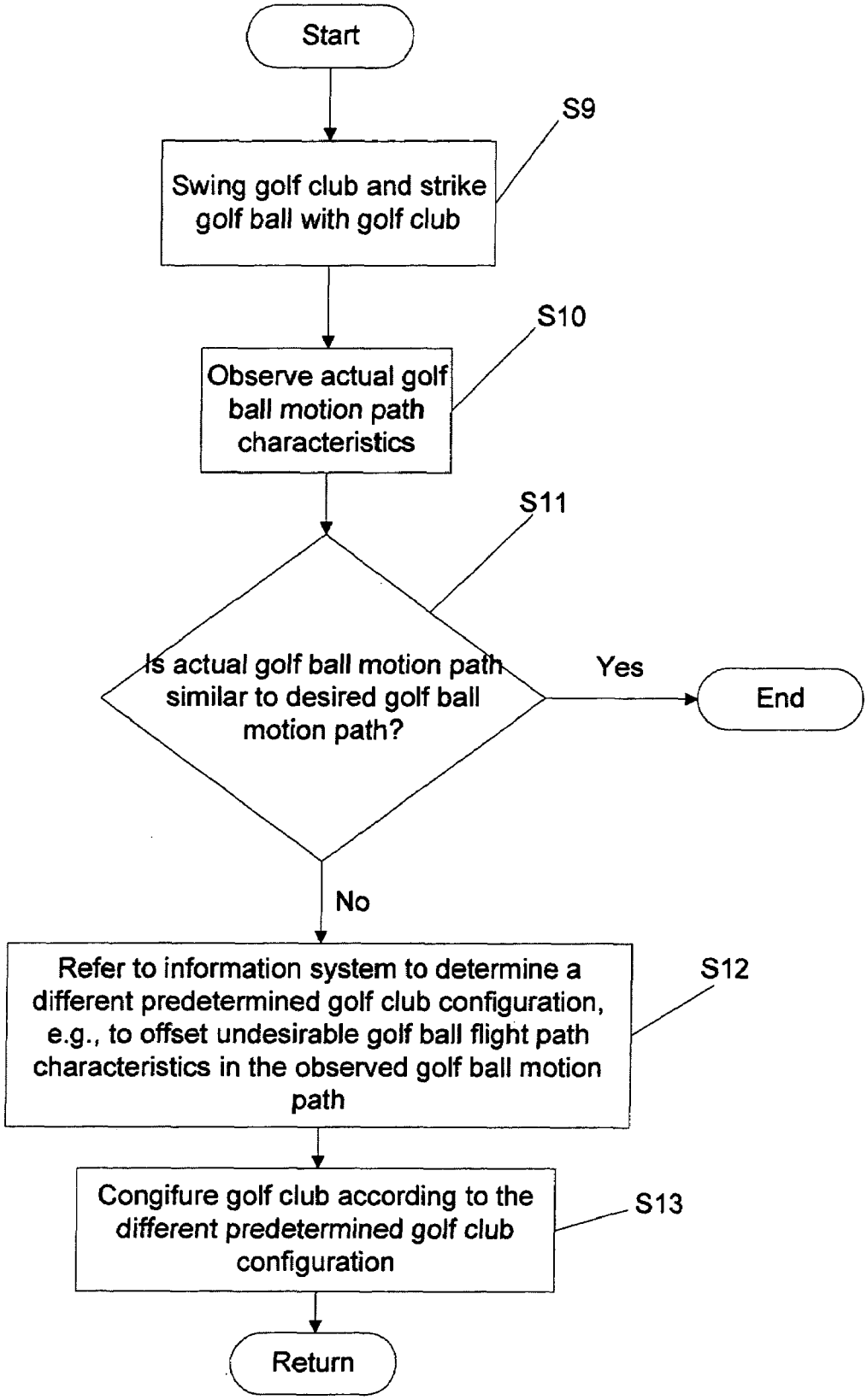
FIG. 18 is a flow chart of a method of using the golf club information system for a beginner to intermediate golfer.

As shown in FIG. 18, according to an embodiment of a method of using a golf club information system suited for a beginning to intermediate golfer, e.g. a golfer having a golf swing that tends to result in a struck golf ball flight path that significantly deviates from an intended flight path, a golfer swings the golf club with a first head mass configuration and strikes a golf ball resulting in a first actual golf ball motion path in Step S9. In Step S10, the first actual golf ball motion path characteristics, e.g., shot shape and/or trajectory, are observed by a user, e.g., the golfer. In Step S11, the actual golf ball motion path characteristics are compared to a desired golf ball motion path. If the first actual golf ball motion path is substantially similar to the desired golf ball motion path, no further reconfiguration of the golf club head is required.

If, however, the first actual golf ball motion path differs from the desired golf ball motion path, the process proceeds to Step S12, in which the user refers to the information system to select a second predicted golf ball motion path with flight characteristics that will negate or offset the undesirable flight characteristics of the first actual golf ball motion path compared to the desired golf ball motion path. For example, if a user seeks to achieve a golf ball motion path having a weak draw shot shape and a medium trajectory but the first head mass configuration produces an actual golf ball motion path that has a strong fade shot shape and a low trajectory, a user may desire to reconfigure the golf club head mass configuration to induce a strong draw shot shape and a high trajectory, thereby negating the tendency to hit a strong fade shot shape and a low trajectory.

In Step S13, the user reconfigures the golf club head mass configuration according to the configuration marks associated with the second predicted golf ball motion path to achieve a second golf club head mass configuration and repeats the process by returning to S9 and striking a golf ball with the reconfigured golf club to create a second actual golf ball motion path. As with the first actual golf ball motion path, the second actual golf ball motion path characteristics are observed and compared to the desired golf ball motion path. Following a similar process as outlined above, a comparison is made and reconfiguring of the golf club head configuration is performed as necessary. The above steps are repeated until an actual golf ball motion path is substantially similar to the desired golf ball motion path.

In some embodiments, a user strikes multiple golf balls by swinging a golf club with a first head mass configuration resulting in multiple actual golf ball motion paths and takes an average of the actual golf ball motion paths to calculate a first actual golf ball motion path that is compared to the desired golf ball motion path.

FIG. 19 EXAMPLE

Figure 19:
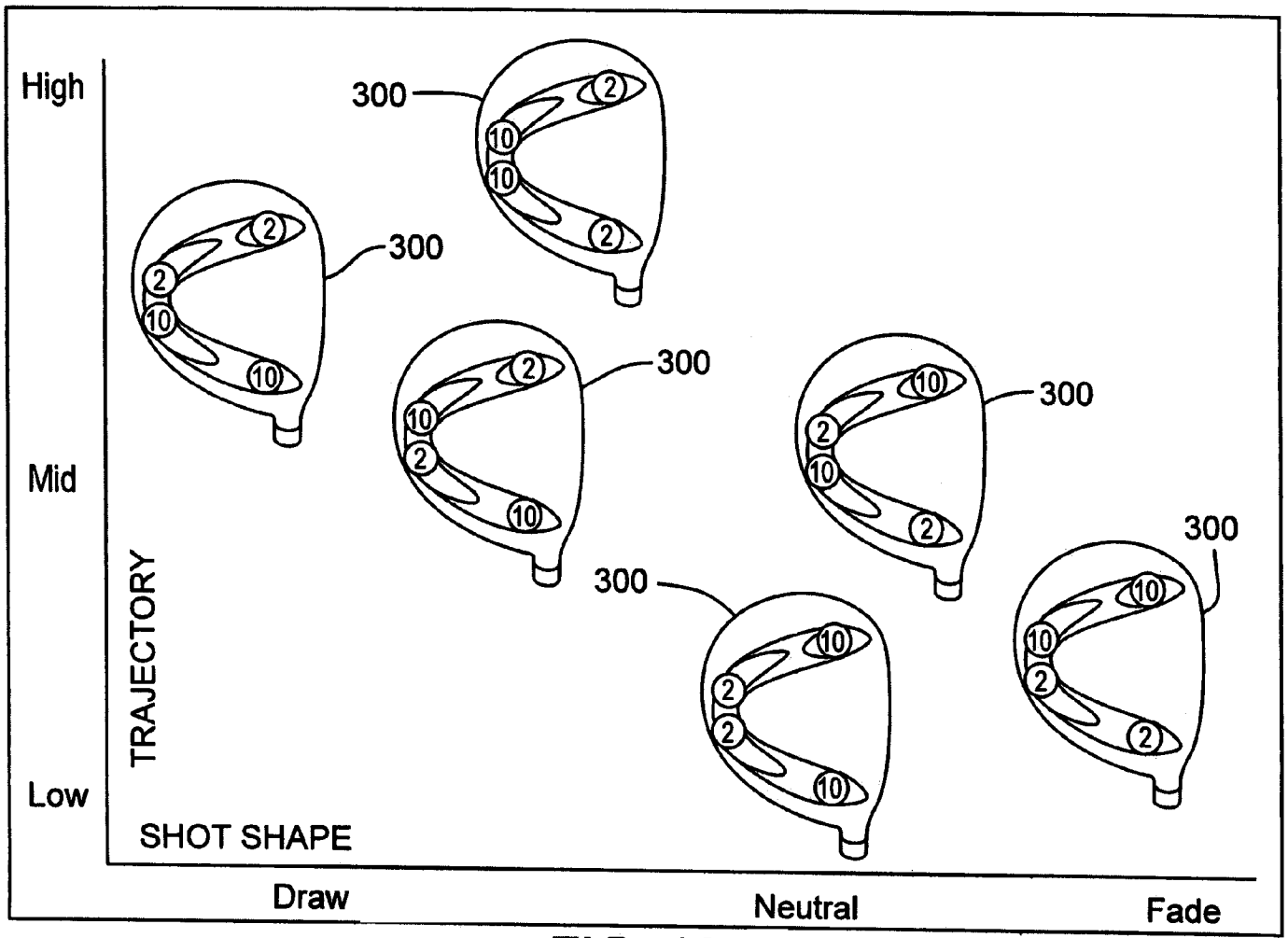
FIG. 19 is another embodiment of a golf club information system.

In other embodiments, an information system has one member with a visual representation, such as, e.g., a graph, including multiple graphics 300 of a golf club having a golf club configuration. Each graphic of a golf club can be positioned on a location of the graph corresponding to a predicted golf ball motion path. For example, each of the different predicted golf ball motion path points illustrated in FIG. 13 can be replaced with a graphic of a golf club head having a configuration corresponding to the predicted golf ball motion path associated with the predicted golf ball motion path point as shown in FIG. 19.

FIG. 20 EXAMPLE

Figure 20:
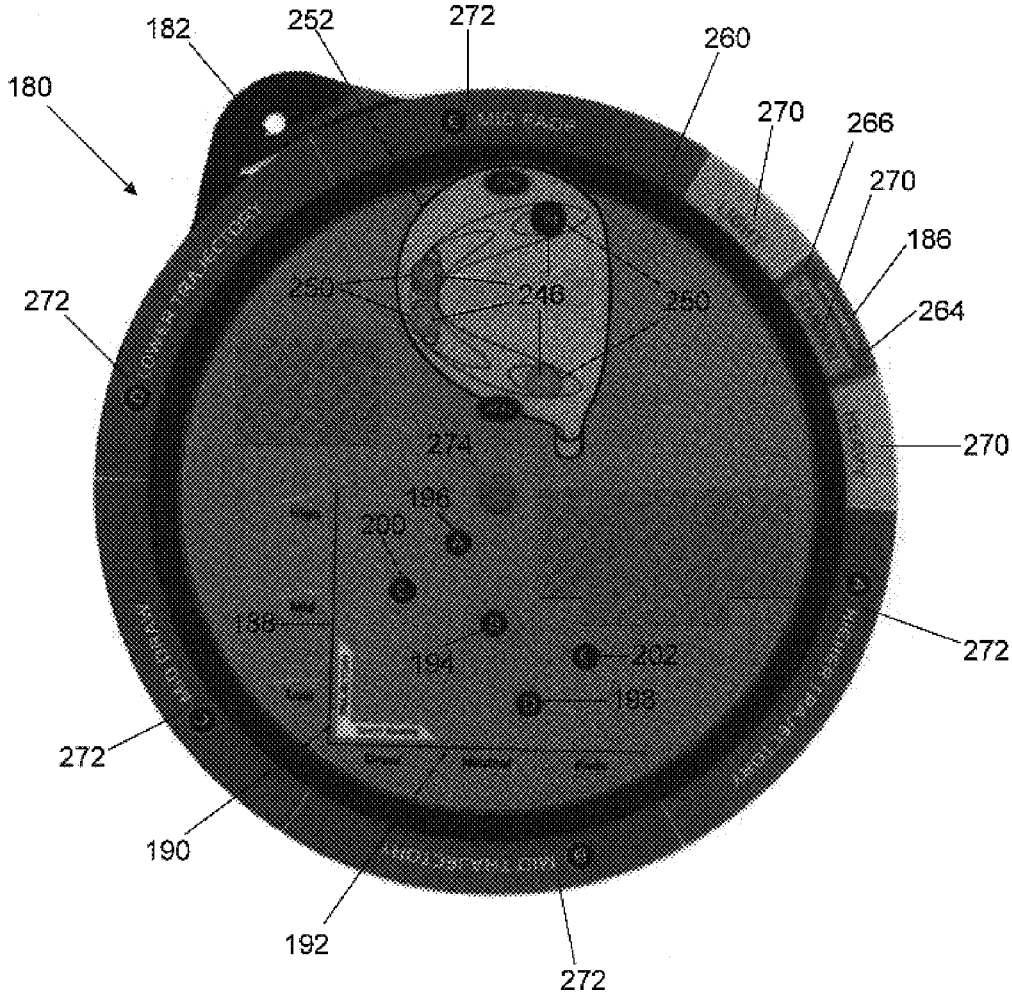
FIG. 20 is a top plan view of another embodiment of a golf club information system.

With reference to FIG. 20, an information system 180 according to another specific embodiment of the present application provides for selecting a desired golf club configuration based on three parameters, rather than two parameters as in the prior examples. For example, the information system can account for a third parameter, such as e.g., a user's swingweight, in addition to the shot shape and trajectory.

According to one approach, these three parameters and their selection can be presented in graphic form. For example, the information device can be an instruction wheel 182 as shown in FIG. 20. Also, as shown in FIG. 20, and similar to the embodiment shown in FIG. 13, instruction wheel 182 has a first member 184 and a second member 186. The first member 184 overlies and is associated with the second member 186. The first member 184 and the second member 186 are movably connected.

The first member 184 includes a visual representation, e.g., graph 188, illustrating multiple predicted golf ball motion paths corresponding to golf club head mass configurations. The graph's y-axis 190 corresponds to predicted golf ball motion path trajectory components, generally ranging from low to high. The x-axis 192 corresponds to predicted golf ball motion path shot shape components, generally ranging from draw to fade.

According to the specific embodiment of an instruction wheel 182, as shown in FIG. 20, a graph 188, located on first member 184 of the instruction wheel, can include five predicted golf ball motion path points. The predicted golf ball motion paths points include, but are not limited to, a neutral shot shape with a medium trajectory motion path point 194, a weak draw shot shape with a high trajectory motion path point 196, a weak fade shot shape with a low trajectory motion path point 198, a medium draw shot shape with a medium trajectory motion path point 200, and a medium fade shot shape with a medium trajectory motion path point 202.

Figure 21:
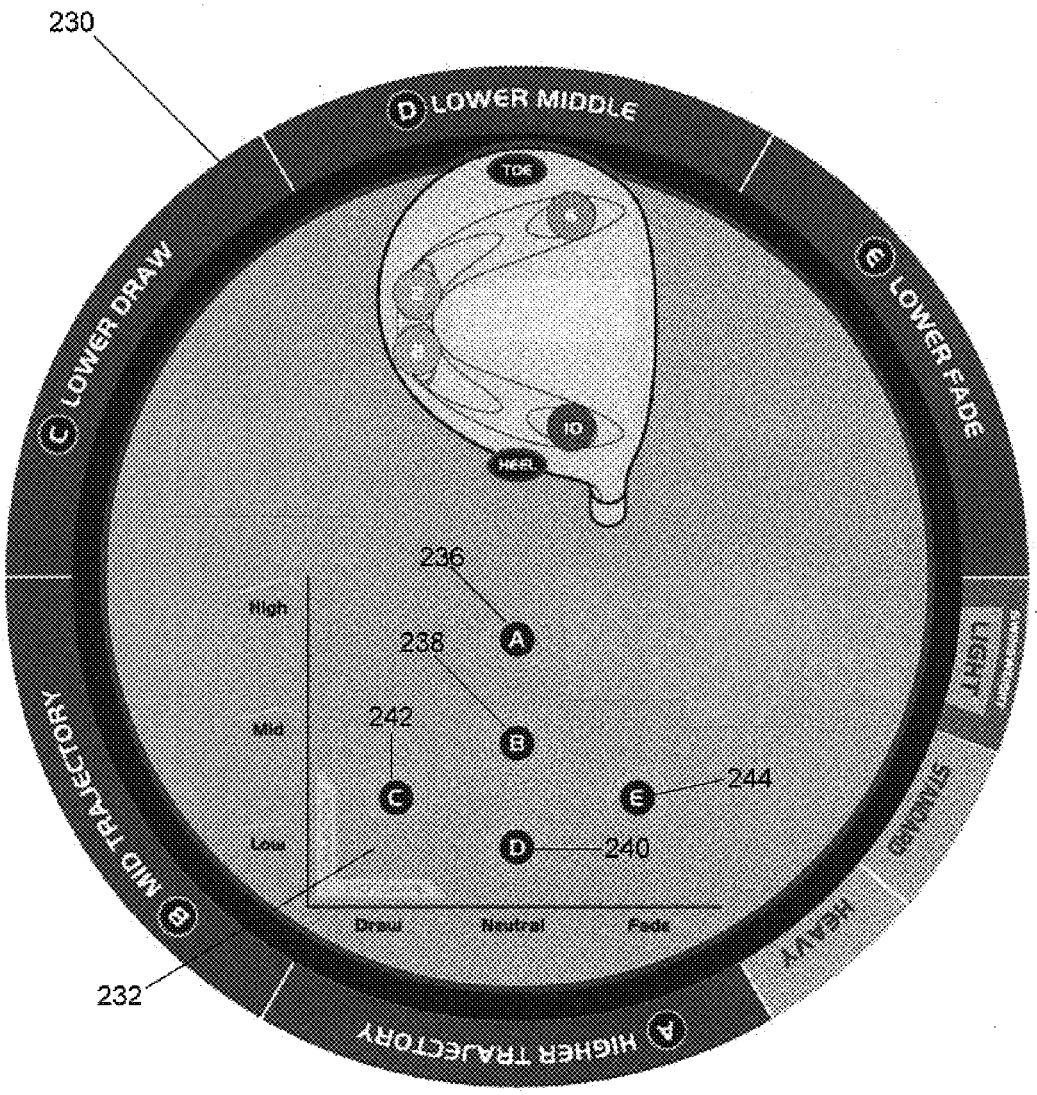
FIG. 21 is a top plan view of another embodiment of a golf club information system.

In an alternative specific embodiment, instruction wheel 230 provides a more conservative selection of predicted golf ball motion paths. As shown in FIG. 21, graph 232, located on first member 234 of the instruction wheel 230 includes five predicted golf ball motion path points. The points include, but are not limited to, a neutral shot shape with a high trajectory motion path point 236 a neutral shot shape with a medium trajectory motion path point 238 a neutral shot shape with a low trajectory motion path point 240 a medium draw shot shape with a low trajectory motion path point 242 and a medium fade shot shape with a low trajectory motion path point 244.

Figure 22:
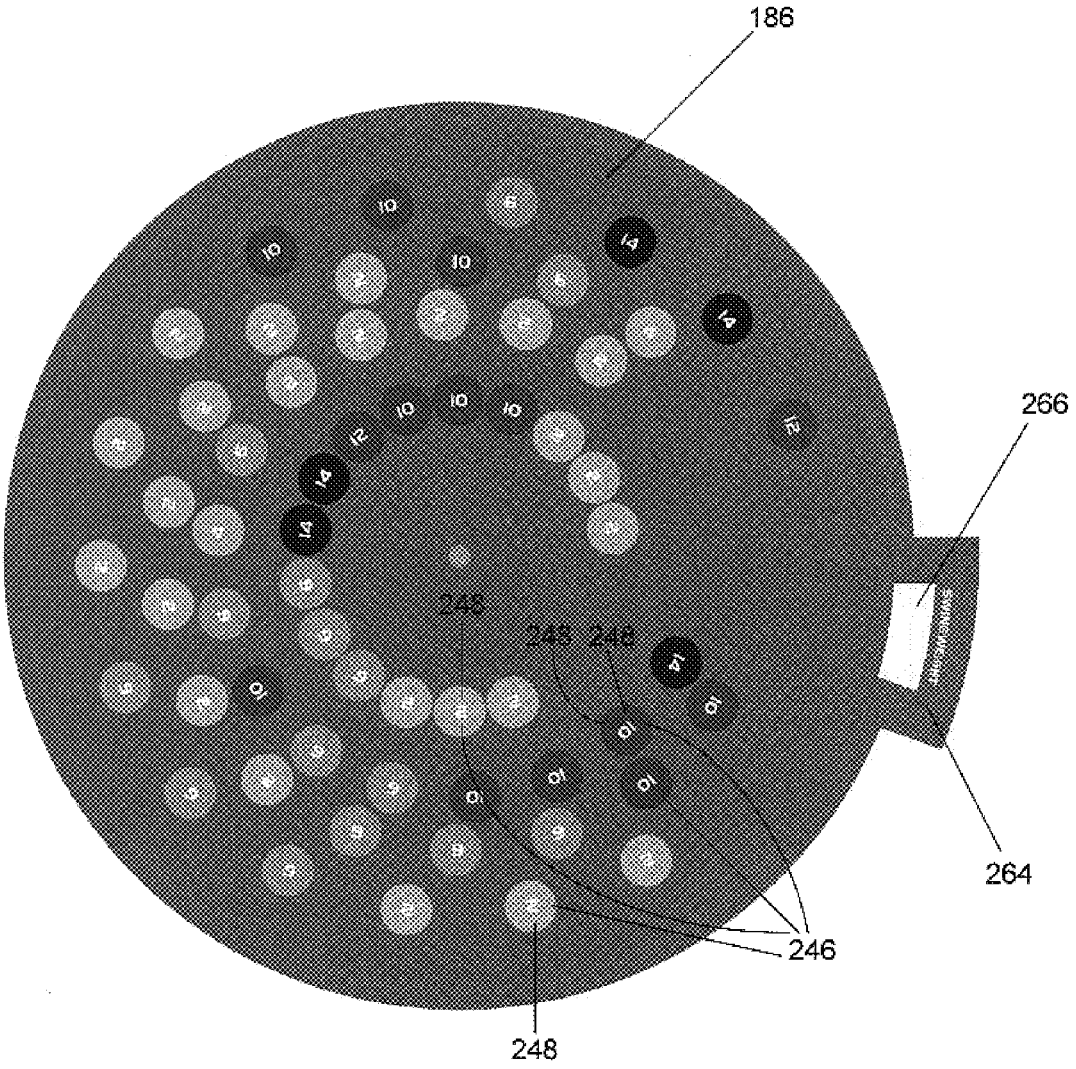
FIG. 22 is a top plan view of the second member of the information system of FIG. 20.

According to the embodiment of the information wheel 182 shown in FIG. 20, golf club head configurations are represented by correlated multiple marks, as exemplified by correlated multiple marks 246 best shown in FIG. 22, located on second member 186, where each mark 248 represents a weight having a predetermined mass, such as, e.g., a 14-gram mass, a 12-gram mass, a 10-gram mass, a 6-gram mass, or a 2-gram mass. The correlated multiple marks 246 are schematically arranged to represent the locations of weights 24 around a golf club head 28. For example, as shown in FIGS. 20 and 22, the correlated multiple marks 246 include four marks, where each mark 248 is positioned on the second member 186 according to the location of a removable weight 24 received into golf club head 28 via recesses 96, 98, 102 and 104 (FIGS. 2-5).

Figure 23:
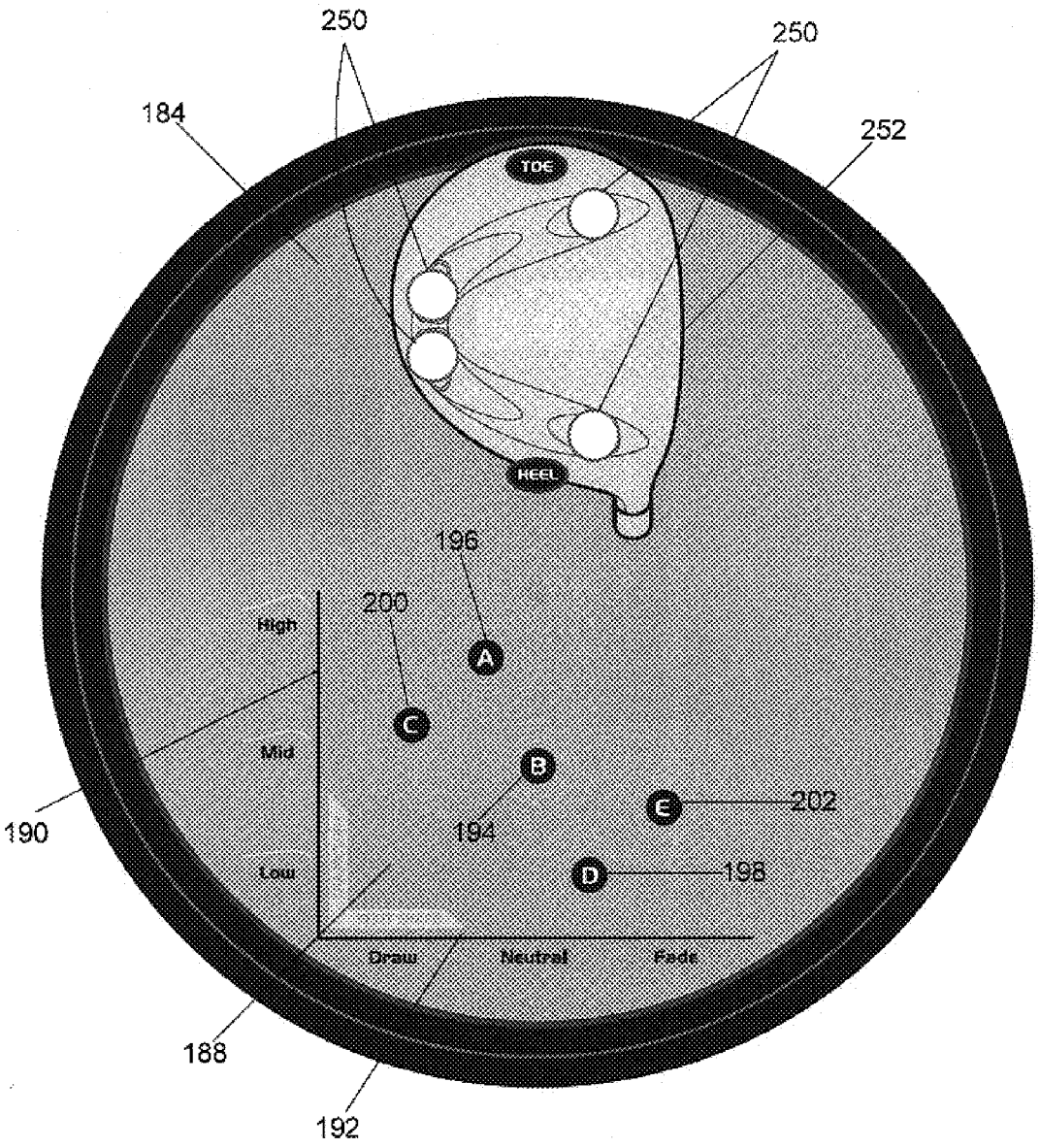
FIG. 23 is a top plan view of a first member of the information system of FIG. 20.

The correlated multiple marks 246 of FIG. 20 are viewable through openings 250 (FIGS. 20 and 23) located on the first member 184 upon proper rotational alignment. The openings 250 are positioned at locations on a graphic 252 of a golf club head also located on the first member 184. As discussed above, each opening 250 is positioned at a location on the graphic 252 corresponding to the location of a recess for receiving removable weights 24 on the golf club head 28. For example, as shown in FIGS. 20 and 23, the openings 250 include four openings corresponding to the location of the four recesses 96, 98, 102 and 104 around the periphery of golf club head 28 (FIGS. 2-5).

Figure 24:
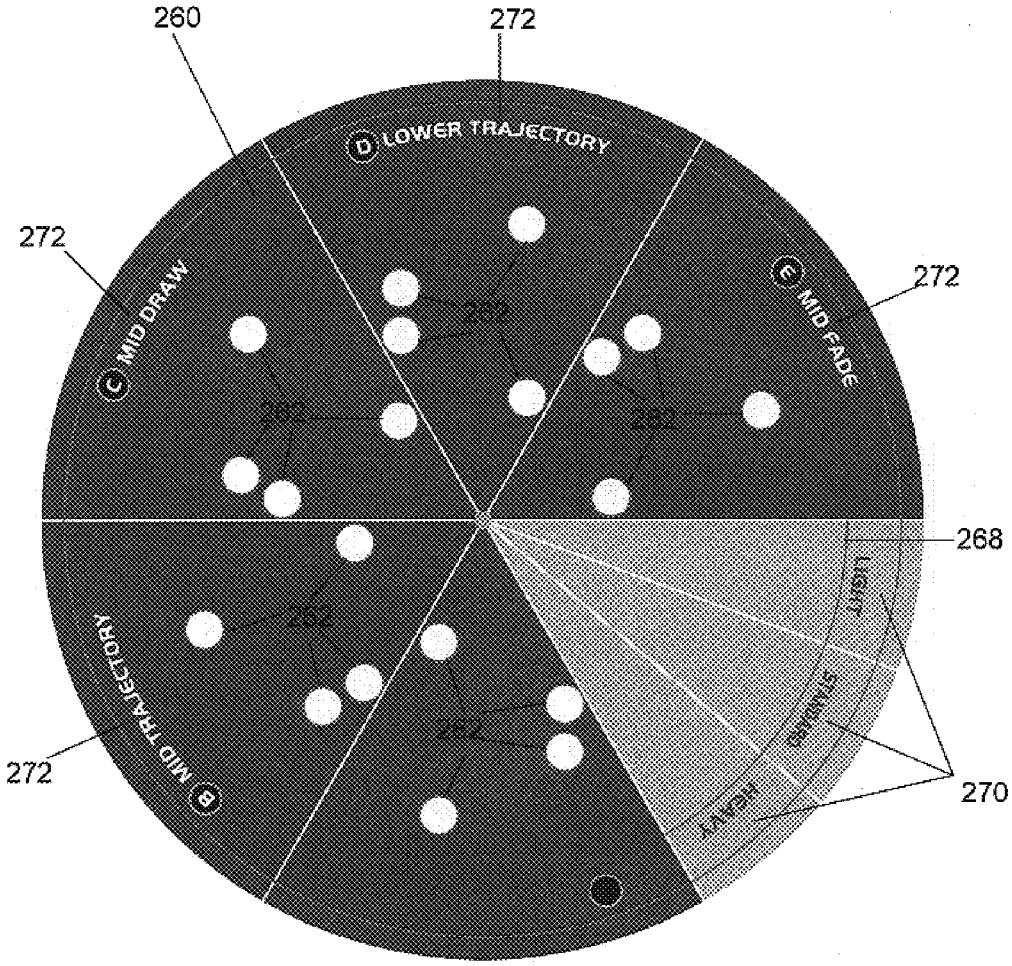
FIG. 24 is a top plan view of a third member of the information system of FIG. 20.

The correlated multiple marks 246 are further viewable through one of a set of openings 262, shown in FIG. 24, located on a third member 260. Each set of openings 262 corresponds with one of multiple predicted golf ball motion paths, for example, one of the predicted golf ball motions path points indicated on graph 188. In the embodiment shown in FIG. 20, third member 186 includes five sets of openings 262 corresponding to the five predicted golf ball motion path points shown on graph 188. For example, FIG. 20 shows an instruction wheel where predicted golf ball motion path point 202, described in this working embodiment as "mid fade," is selected and a golf club head mass configuration having one 6-gram weight, one 14-gram weight and two 10-gram weights is associatively displayed.

According to the embodiment of an information system as shown in FIGS. 20 and 22, second member 186 includes correlated multiple marks 246, as discussed above, and also includes a swingweight tab 264 having a swingweight opening 266. When joined to third member 260, swingweight tab 264 is inserted through slit 268 formed in the third member, thereby overlying swingweight indicia 270 on the third member, where the swingweight indicia are viewable through swingweight opening 266 upon proper rotational alignment. Swingweight indicia 270 graphically represent multiple golf club swingweights, generally, i.e., the measure of how the golf club feels during a swing. More specifically, swingweight is a balance measurement of the degree to which the club balances away from a grip end of the club toward the club head. For example, a golf club that balances closer to the club head has a heavier swingweight than a club that balances further away from the club head.

According to the embodiment shown in FIG. 20, swingweight indicia 270 include light swingweight indicium, standard swingweight indicium and heavy swingweight indicium. Each of the swingweight indicia 270 is correlated with one of the correlated multiple marks 246 on second member 186. When a particular swingweight indicium is viewed through swingweight opening 266, marks corresponding to a predicted golf ball motion path with the golf club swingweight associated with the particular indicium is viewed through openings 250 and 262 on the first member 184 and third member 260, respectively, upon proper rotational alignment of the first and third members. For the embodiment shown in FIG. 20, proper rotational alignment can occur when openings 250 on first member 184 align with a set of openings 262 on third member 260 that corresponds with a selected predicted golf ball motion path.

Figure 25:
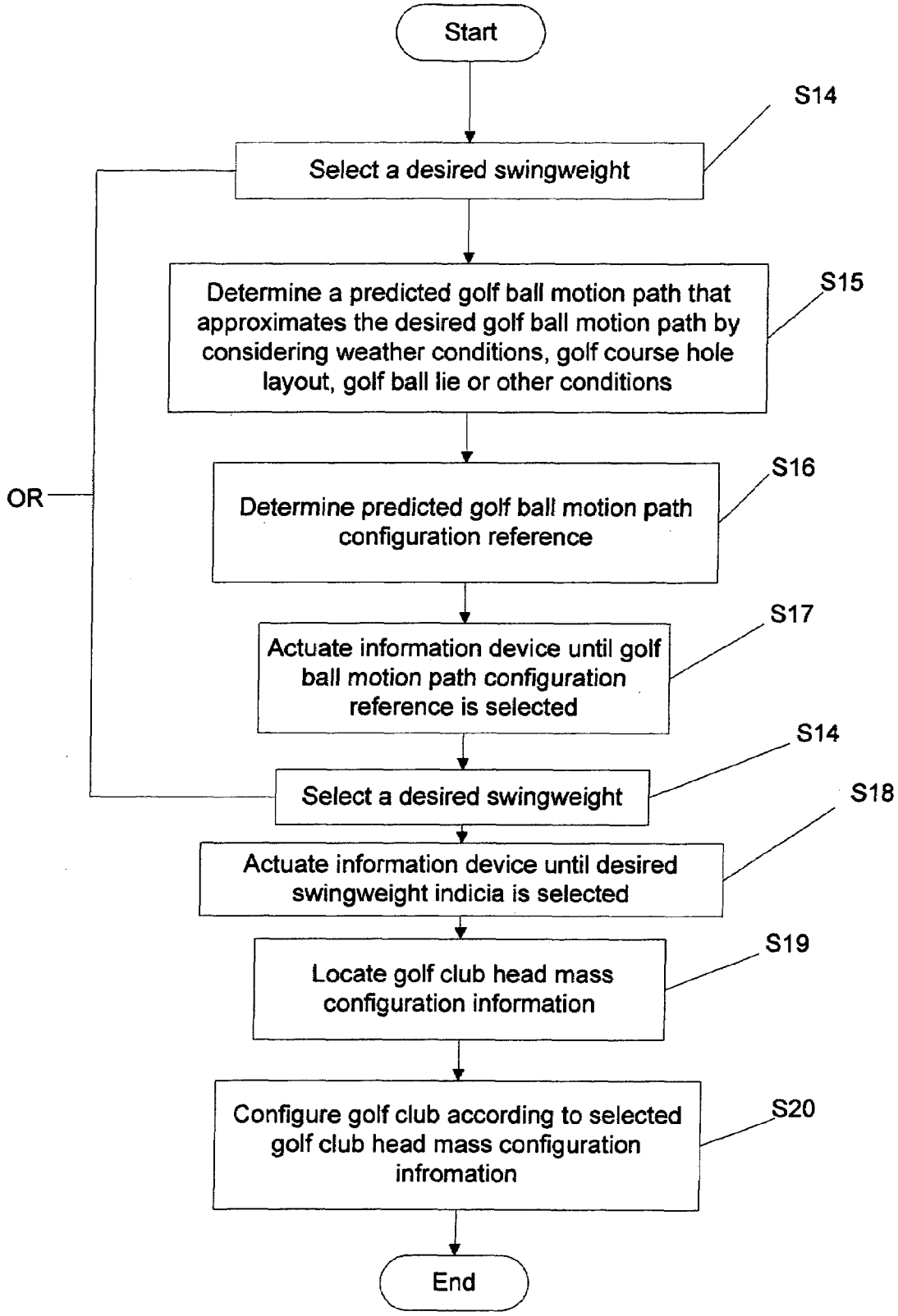
FIG. 25 is a flow chart of a method of using a golf club information that compensates for a golf club swingweight.

According to some embodiments of a method of using an instruction wheel, a user may configure a golf club with a desired swingweight and configuration that produces a desired golf ball motion path. For example, a method similar to the method of using the information system of FIG. 16, as described above, is shown in FIG. 25. However, as shown in FIG. 25, the user, in Step S 14, selects one of several swingweights, including, but not limited to, a light, standard or heavy swingweight. The user can select a swingweight prior to or after selecting one of the multiple predicted golf ball motion paths associated with the predicted golf ball motion path points 194, 196, 198, 200 or 202 from graph 188 that best approximates a desired golf ball motion path determined by the user.

In Step S18, a user may select a desired swingweight by rotating second member 186 relative to the third member 260 until a swingweight indicia 270 corresponding to the desired swing-weight is viewable through swingweight opening 266 on swingweight tab 264. As shown in FIG. 20, swingweight indicium 270 corresponding to a standard swingweight is selected and viewable through swingweight opening 266.

According to S18, once a first predicted golf ball motion path is selected that best approximates the desired golf ball motion path, the user determines the predicted golf ball motion path configuration reference 272 located on the third member 260 that is associated with the first predicted golf ball motion path, and rotates the first member 184 relative to third member, or vice versa, until the openings 250 on the first member are aligned with the set of openings 262 on the third member corresponding to the first predicted golf ball motion path (FIG. 24). Although not shown, in one embodiment, a configuration reference is a number, letter or other indicium that is viewable through a center opening on the first member 184. In another embodiment, a configuration reference is a predicted golf ball motion path description, number, letter or other indicium located on a periphery of third member 260. In yet another embodiment, as shown in FIG. 20, the configuration reference 272 is a combination of a letter and a description on the periphery of third member 260.

According to Step S19, when the openings 250 are aligned with the selected predicted golf ball motion path configuration reference 272, or after proper rotational alignment of the first and third members 184 and 260, respectively, the marks 246 representing the golf club head mass configuration corresponding to the predicted golf ball motion path and selected swingweight are viewable through the openings 250 located on graphic 252 of golf club head 28 and a set of openings 262 located on the third member 260. In this way, a golf club having a desired swingweight and a configuration for achieving a desired golf ball motion path is conveyed by the information system 180. In Step S20, the user is then able to utilize the golf club head mass configuration marks 246 as viewed and configure the golf club by arranging the removable weights 24 according to the marks. For example, in the embodiment shown in FIG. 20, the user would attach a 14-gram weight in the toe recess 102, a 6-gram weight in the rear recess 98 and a 2-gram weight in each of the rear recess 96 and heel recess 104 of club head 28 (FIGS. 2-5). In this way, a user can vary a swingweight of a golf club and configure the golf club to achieve a desired golf ball motion path.

According to another embodiment of a method of using the embodiment of a golf club information system as shown in FIG. 20, a user swings the golf club with a first head mass configuration corresponding to the viewed head mass configuration marks and strikes a golf ball resulting in a first actual golf ball motion path. The method further includes the actions associated with the embodiment of a method of using the information system shown in FIG. 13 described above. As described above, the user practices the method until an actual golf ball motion path is substantially similar to the desired golf ball motion path.

Figure 26:
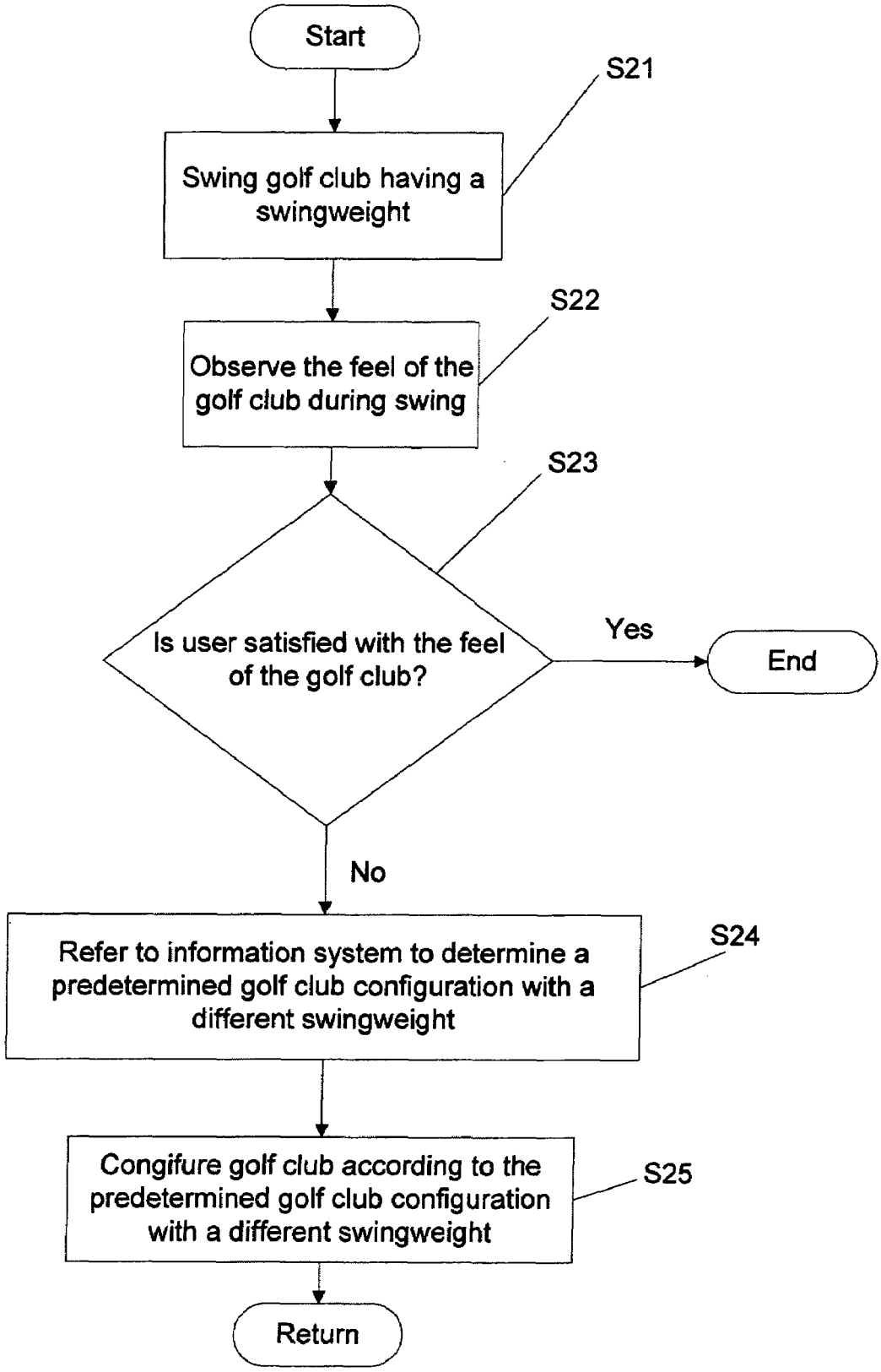
FIG. 26 is a flow chart of another method of using a golf club information system that compensates for a golf club swingweight.

Building on the embodiments as discussed above, according to a method shown in FIG. 26, in Step S21, a user may swing a golf club with a first head mass configuration corresponding to a predicted golf ball motion path and one of several swingweights. In Step S22, the user observes the feel of the golf club during the swing. As determined in Step S23, if satisfied with the feel of the club, a user need not use the golf information system 180 to reconfigure the golf club to a different swingweight and the process ends. If, however, the user is not satisfied with the feel of the club, the process proceeds to Step S24, in which the user refers to the information system to determine a predetermined golf club configuration with a swingweight approximating a desired swingweight. Once a new predetermined golf club configuration is determined, the user can rotate second member 186 until a different swingweight is viewable through swingweight opening 266 and, in Step S25, configure the golf club head mass configuration according to the marks 246 viewable through openings 250 and 262 of first member 184 and third member 260, respectively. In this way, a user can vary a swingweight of a golf club while maintaining a predicted golf ball motion path configuration of that golf club.

Although the first member 134 and second member 136 of the embodiment shown in FIG. 13, and the first member 184, second member 186 and third member 260 of the embodiment shown in FIG. 20, are disc shaped, in other embodiments, the information device can have members of any other suitable shape, such as a polygon, square or oval. Furthermore, in some embodiments, a first member can be slidably coupled to a second member where a user can calculate a golf club head configuration by sliding the first member relative to the second member until a golf club head configuration corresponding to a selected predicted golf ball motion path is viewed through the first member.

In the illustrated embodiments shown in FIGS. 13 and 20, the members can be connected by a rivet 272 or eyelet. The members the disclosed embodiments are generally sheet like and may be made substantially from a cardstock, a plastic or other sheet material.

FIG. 27 EXAMPLE

Figure 27:
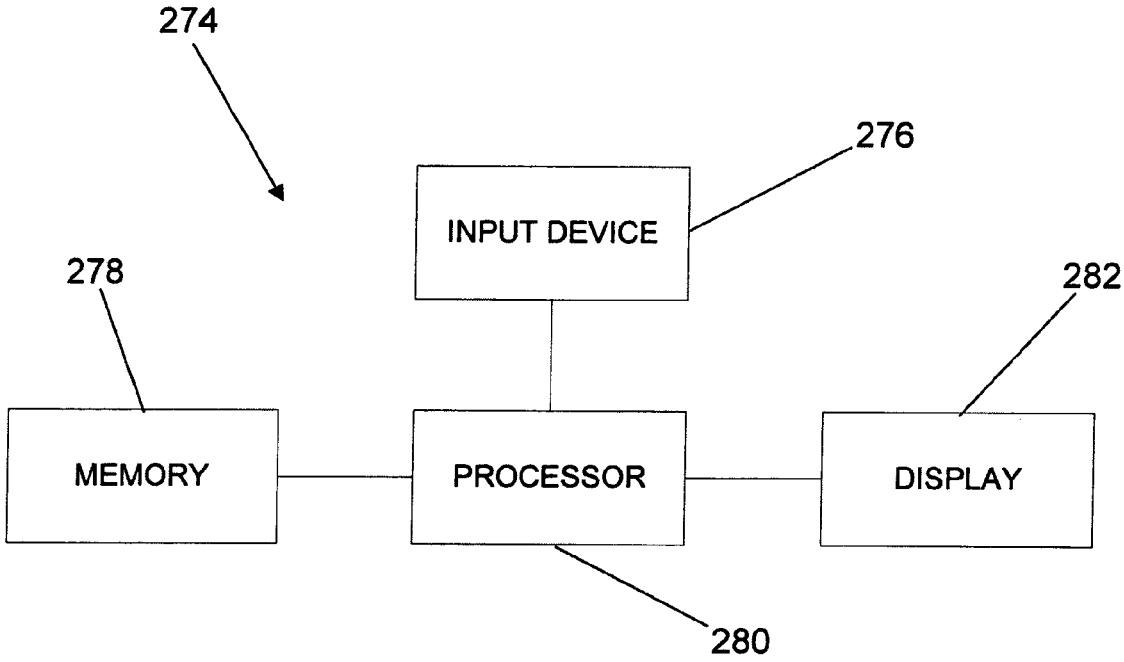
FIG. 27 is a block diagram illustrating one embodiment of an electronic golf club information system embodied as a microprocessor device.

FIG. 27 shows an information system configured for use with an electronic device 274. The device 274 typically includes at least an input device 276, a memory 278, a processor 280 and a display 282. In some embodiments, the device 274 is one of, or a combination of, a computer, PDA, cellular telephone, or other computing device.

The input device 276 facilitates entry of golf club information into the device 274. In one embodiment, the input device 276 facilitates entry of desired golf ball motion paths or golf ball motion path components such as trajectory and/or shot shape components. In another embodiment, golf club swingweight can be an additional input entered into the input device 276.

In some embodiments, the user interacts with the input device 276 via a graphical user interface (GUI). The GUI may include one screen or several screens and may visually prompt a user to select, from a plurality of golf ball motion path selections, in the form of textual descriptions or graphical illustrations, a desired golf ball motion path. As an example, the input device 276 can be one of, or a combination of, a keyboard, keypad, mouse, computer screen, PDA screen, voice-recognition device or other electronic communication device.

Figure 28:
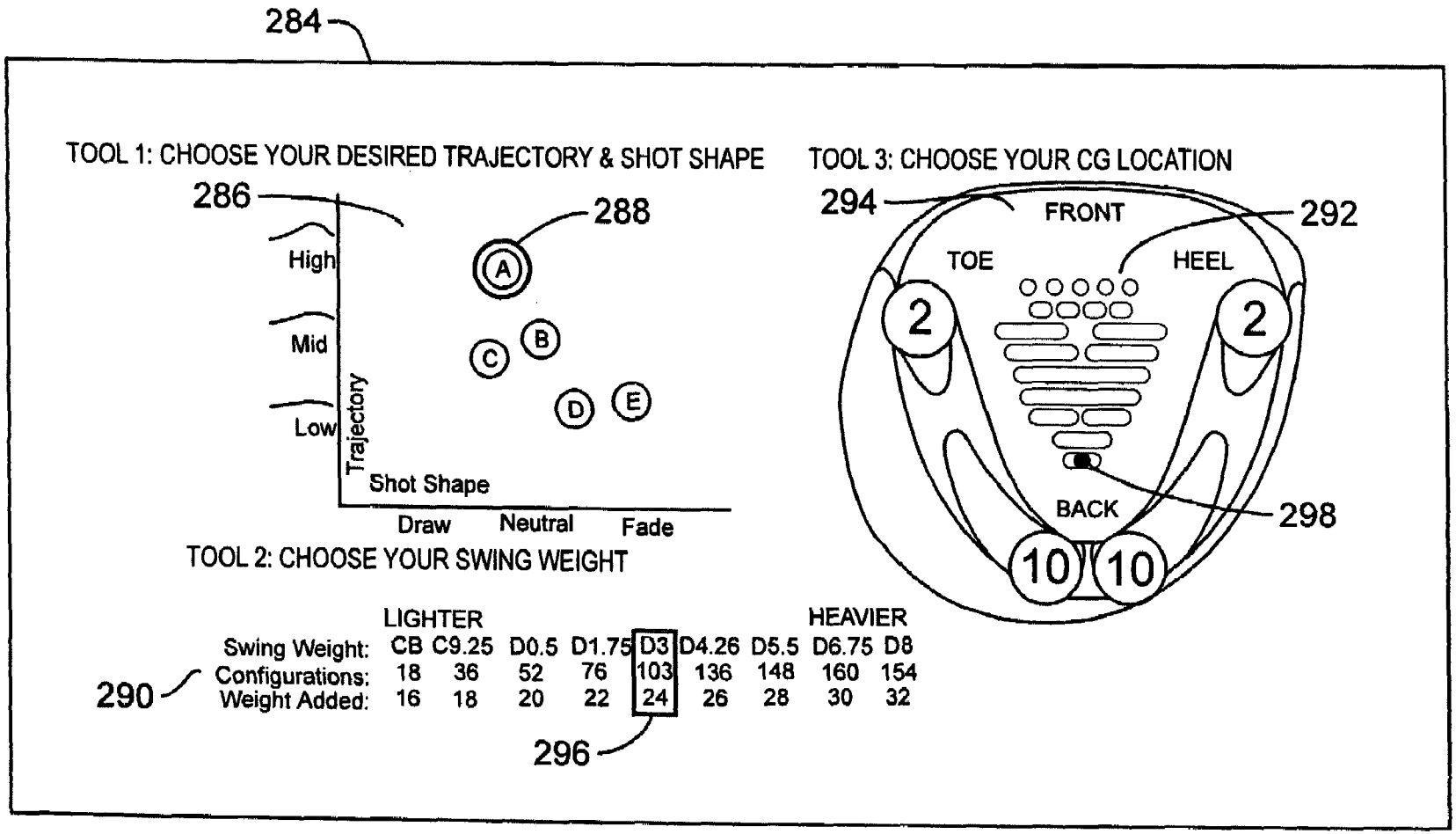
FIG. 28 illustrates a representative graphical user interface (GUI) of the information system such as may be used with an electronic golf club information device.

In some embodiments, as shown in FIG. 28, the input device 276 includes an internet web site GUI 284. In specific embodiments, website GUI 284 includes a predicted golf ball motion path selection tool 286. The predicted golf ball motion path tool 286 can be utilized by selecting and moving target 288 to a location on the tool 286 that best represents a desired golf ball motion path. A golf club head mass configuration corresponding to the selected golf ball motion path is associatively displayed in a graphic 294 of a golf club head representation. In other specific embodiments, GUI 284 includes a swingweight tool 290 facilitating the entry of a desired swingweight. The swingweight tool 290 can be utilized by selecting and moving selection box 296 to a desired golf club swingweight listed on the swingweight tool. The golf club head mass configuration corresponding to the selected swingweight would then displayed in the graphic 294. In still other specific embodiments, the GUI 284 includes a CG tool 292, which can be conveniently located on the graphic 294, facilitating the entry of a desired golf club head mass CG location. The CG tool 292 can be utilized by selecting and moving a CG position indicator 298 to a desired location on the graphic 294. The golf club head mass configuration corresponding to the desired CG would then be displayed in the graphic 294.

In some embodiments, the internet web site GUI 284 includes the selection tool 286, swingweight tool 290, CG tool 292, or any combination thereof. In embodiments having a combination of tools, such as tools 286, 290 or 292, a user can input a combination of desired characteristics into the tools and graphic 294 displays a golf club head mass configuration factoring in each of the inputted characteristics.

The processor 280 is electronically coupled with the input device 276, the memory 278 and the display 282. The memory 278 stores a plurality of predicted golf ball motion paths and corresponding golf club head mass configurations. Processor 280 calculates a predicted golf ball motion path that best approximates the desired golf ball motion path entered by the user. The processor 280 calculates the predicted golf ball motion path by separating the shot shape component and the trajectory component of the desired golf ball motion, if necessary, and selecting a predicted golf ball motion path having the same or similar components. In some embodiments, the desired golf ball motion path includes a corresponding swingweight and the processor selects a predicted golf ball motion path with the same or similar swingweight. The display 282 visually or audially conveys the calculated golf club head mass configuration and/or the predicted golf ball motion path corresponding to the entered desired golf ball motion path. The user is then able to utilize the displayed information to configure a golf club.

In one particular embodiment, as shown in FIG. 28, display 282 includes an internet web site display. For example, once a location on the tool 286 is selected, the golf club head mass configuration corresponding to the selected golf ball motion path is shown on a golf club head mass configuration display 294. Additionally, once a desired swingweight is selected using the swingweight tool 290, the golf club head mass configuration having the selected swingweight is displayed on the display 294. The display 294 can also communicate a golf club head mass configuration corresponding to a desired CG selected using the CG tool 292.

While the above embodiments refers to a method of configuring a golf club head, it is recognized that the information system of the present application may apply to configuring other aspects of a golf club, for example, shaft, grip, hosel, etc.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. An information system for selecting from among a plurality of configurations of a golf club head, comprising:

a first member having thereon a graphic depicting a golf club head, the first member forming at least one opening positioned on the graphic; and a second member having at least one mark thereon corresponding to at least one of a plurality of configurations of the golf club head associated with at least one of a corresponding plurality of predicted golf ball flight paths, the second member being movably coupled to the first member;

wherein the at least one mark is positioned on the second member relative to the at least one opening according to a relationship between the predicted golf ball flight paths and the plurality of configurations of the golf club head, and wherein the first and second members are movable relative to each other for displaying the at least one mark on the second member within the at least one opening in the first member according to a selected golf ball flight path.

2. The information system of claim 1, wherein the second member is rotatably coupled to the first member, and the first and second members are rotatable relative to each other.

3. The information system of claim 1, wherein the openings in the first member are first openings, the information system further comprising a third member having at least one second opening corresponding to the predicted golf ball flight path, the third member being positioned between the first member and the second member, wherein at least one of the marks is displayed when the first and second openings are rotated into mutual alignment.

4. The information system of claim 3, wherein the third member includes swingweight indicia thereon corresponding to the at least one golf club head configuration, the swingweight indicia being displayable through the second member.

5. An information system providing information for selecting a golf club configuration from a plurality of possible golf club configurations to achieve a desired golf ball motion path for a golf ball struck by the golf club having the selected golf club configuration, comprising:

a first set of indicia on a first surface representing a plurality of predicted golf ball motion paths; and an associated second set of indicia on a second surface providing a plurality of instructions to configure the golf club configuration according to each respective one of the plurality of predicted golf ball motion paths as indicated by the first set of indicia, wherein the first and second sets of indicia are positioned relative to each other and the first and the second surfaces according to a relationship between the predicted golf ball motion paths and the golf club configuration, and the first and the second surfaces are correspondingly configured such that at least one indicium of the first set corresponding to a selected one of the plurality of golf ball motion paths is presented in combination with at least one indicium of the second set for providing instructions to configure the golf club configuration to achieve a desired golf ball motion path corresponding to the selected one of the golf ball motion paths;

wherein the first surface is a surface of a first member and the second surface is a surface of a second member distinct from the first member; and wherein the first member comprises a graphic depicting a golf club head and includes openings located at predetermined positions, and wherein the second set of indicia comprises multiple groupings of marks, wherein each grouping of marks corresponds to instructions to configure the golf club head according to a selected one of the predicted golf ball motion paths, and wherein one of the multiple groupings of marks is viewable through the openings upon proper rotational alignment of the first and second members.

6. The information system of claim 5, wherein the first set of indicia representing the predicted golf ball motion paths are presented in a graphical format illustrating the flight characteristics of the predicted golf ball motion paths relative to each other.

7. The information system of claim 5, wherein the second set of indicia includes instructions for redistributing a mass of a golf club head.

8. The information system of claim 7, wherein the instructions include specification of at least one of a plurality of movable weights.

9. The information system of claim 7, wherein the instructions include specification of a location for at least one of a plurality of movable weights.

10. The information system of claim 5, wherein the second set of indicia includes instructions for increasing or decreasing a mass of a golf club head.

11. The information system of claim 10, wherein the instructions include specification of at least one movable weight and at least one movable weight location.

12. The information system of claim 5, wherein the predicted golf ball motion path approximates the desired golf ball motion path.

13. The information system of claim 5, further comprising a selector operably associated with the first and second surfaces, the selector providing a visual guide to the user in selecting desired information from at least one of the first set of indicia and the second set of indicia.

14. The information system of claim 5, wherein the first set of indicia includes a plurality of golf club swingweights.

15. The information system of claim 14, wherein the second set of indicia includes instructions to configure the golf club configuration according to a selected one of the plurality of golf club swingweights indicated by the first set of indicia.

16. The information system of claim 5, wherein each of the plurality of predicted golf ball motion paths includes a trajectory component and a shot shape component.

17. The information system of claim 16, wherein the trajectory component includes a high trajectory motion path, a medium trajectory motion path, or a low trajectory motion path.

18. The information system of claim 5, wherein the predicted golf ball motion path includes a swingweight component.

19. The information system of claim 5, wherein the second surface is the same as the first surface.

20. The information system of claim 5, wherein proper rotational alignment is achieved by rotating the first member relative to the second member until the first openings are aligned with one of the multiple groupings of marks corresponding to a selected one of the plurality of predicted golf ball motion paths indicating the desired golf ball motion path.

21. The information system of claim 5, wherein the first and second members comprise circular members rotatable around a common axis.

22. The information system of claim 5, further comprising a third member positioned between the first and second members and rotatably coupled to the first and second members.

23. The information system of claim 22, wherein the openings in the first member are first openings, and wherein the third member comprises multiple groupings of second openings corresponding to respective predicted golf ball motion paths associated with one of a plurality of swingweights, wherein one of the multiple groupings of marks is viewable through one of the multiple groupings of second openings and the first openings upon proper rotational alignment of the first, second and third members.

24. The information system of claim 23, wherein each of the multiple groupings of second openings corresponds with a different one of the plurality of predicted golf ball motion paths.

25. The information system of claim 24, wherein the plurality of swingweights comprises a light swingweight, a standard swingweight or a heavy swingweight.

26. The information system of claim 25, wherein proper rotational alignment is achieved by rotating the first member relative to the third member until the first openings are aligned with one of the multiple groupings of second openings corresponding to one of the plurality of predicted golf ball motion paths, and rotating the second element relative to the first and third elements until a desired swingweight is reached.

27. The information system of claim 5, wherein the system includes an electronic device having a display, and wherein the display is the first surface and the second surface on which the first indicia and the second indicia appear.

28. The information system of claim 27, wherein the first set of indicia and the second set of indicia are viewable on the display in a side-by-side relation.

29. The information system of claim 28, wherein the display comprises a first screen for inputting a desired golf ball motion path.

30. The information system of claim 29, wherein the device comprises a processor programmed to calculate the selected one of the plurality of predicted golf ball motion paths, wherein the selected one of the plurality of predicted golf ball motion paths approximates the desired golf ball motion path.

31. The information system of claim 30, wherein the display comprises a second screen for displaying the second set of indicia.

32. The information system of claim 27, wherein the electronic device is a personal digital assistant (PDA), a wireless telephone, or a combination thereof.

33. An instruction wheel for calculating a proper golf club head configuration to achieve a desired motion path for a golf ball struck by the golf club, comprising:

a first member having a graphic of a golf club head, including first openings positioned at locations on the golf club head, the first member further comprising a lookup table representing a plurality of predicted golf ball motion paths including draw, fade and neutral type shot shapes and low, mid and high type trajectories; and a second member having multiple groupings of marks, wherein each grouping of marks corresponds to one of a plurality of golf club head configurations correlated to one of the plurality of predicted golf ball motion paths, the second member being rotatably coupled to the first member;

wherein said grouping of marks corresponding to one of the plurality of golf club head configurations correlated to one of the plurality of predicted golf ball motion paths approximating the desired motion path is viewable through the first openings upon a proper rotational alignment of the first and second members.

* * * * *

UNITED STATES PATENT AND TRADEMARK OFFICE

CERTIFICATE OF CORRECTION

PATENT NO. : 7,628,707 B2
APPLICATION NO. : 11/025469
DATED : December 8, 2009
INVENTOR(S) : Beach et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 197 days.

Signed and Sealed this

Twenty-first Day of December, 2010

David J. Kappos

David J. Kappos
*Director of the United States Patent and Trademark Office*